US006487833B1

(12) United States Patent
Jaenson et al.

(10) Patent No.: US 6,487,833 B1
(45) Date of Patent: Dec. 3, 2002

(54) STRAP WELDING SYSTEM AND METHOD

(76) Inventors: Howard W. Jaenson, 1432 Covina Hills Rd., Covina, CA (US) 91724; Bradley P. Actis, 6329 Calle Eleante, Rancho Cucamonga, CA (US) 91731

( * ) Notice: Subject to any disclaimer, the term of this patent is extended or adjusted under 35 U.S.C. 154(b) by 79 days.

(21) Appl. No.: 09/657,235

(22) Filed: Sep. 7, 2000

Related U.S. Application Data

(63) Continuation-in-part of application No. 09/493,426, filed on Jan. 29, 2000.

(51) Int. Cl.[7] ..... B65B 13/32

(52) U.S. Cl. ..... 53/399; 53/438; 53/529; 53/590; 100/2; 100/3; 100/33 PB; 156/73.5

(58) Field of Search ..... 53/399, 438, 529, 53/589, 590; 100/2, 3, 8, 10, 16, 25, 26, 33 PB; 156/73.5, 502, 581

(56) References Cited

U.S. PATENT DOCUMENTS

| | | | | |
|---|---|---|---|---|
| 321,542 | A | | 7/1885 | Sheppard |
| 1,732,619 | A | | 10/1929 | Ryan |
| 1,947,918 | A | | 2/1934 | Paxton |
| 2,612,833 | A | | 10/1952 | MacChesney |
| 2,937,484 | A | | 5/1960 | Wiman |
| 3,168,912 | A | | 2/1965 | Marica |
| 3,213,780 | A | | 10/1965 | Nietzel et al. |
| 3,279,355 | A | | 10/1966 | Missioux |
| RE26,289 | E | | 10/1967 | Neitzel et al. |
| 3,477,363 | A | | 11/1969 | Trumbo |
| 3,718,526 | A | | 2/1973 | Annis, Jr. |
| 3,720,158 | A | | 3/1973 | Sauer et al. |
| 3,767,885 | A | | 10/1973 | Fryer |
| 3,791,420 | A | | 2/1974 | Beach |
| 3,834,297 | A | | 9/1974 | Huson |
| 3,863,297 | A | | 2/1975 | Simich |
| 3,863,558 | A | | 2/1975 | Trumbo |
| 3,904,474 | A | * | 9/1975 | Wasco et al. ..... 156/581 |
| 4,055,115 | A | | 10/1977 | Simich et al. |
| 4,062,278 | A | | 12/1977 | Cheung |
| 4,077,313 | A | | 3/1978 | Lems et al. |
| 4,079,667 | A | | 3/1978 | Lems et al. |
| 4,119,449 | A | | 10/1978 | Gould et al. |
| 4,313,779 | A | * | 2/1982 | Nix ..... 100/33 PB |
| 4,353,295 | A | | 10/1982 | Kandarian |
| 4,378,262 | A | | 3/1983 | Annis, Jr. |
| RE31,353 | E | | 8/1983 | Cheung |
| 4,466,535 | A | | 8/1984 | Huson |
| 4,479,834 | A | | 10/1984 | Kobiella |
| 4,484,518 | A | | 11/1984 | Jaenson |
| 4,504,353 | A | * | 3/1985 | Ford ..... 100/2 |
| 4,533,343 | A | | 8/1985 | Kobiella |
| 4,572,419 | A | | 2/1986 | Klaus et al. |
| 4,661,185 | A | | 4/1987 | Kobiella |
| 4,663,915 | A | | 5/1987 | Van Erden et al. |
| 4,683,017 | A | | 7/1987 | Figiel et al. |
| 4,707,390 | A | | 11/1987 | Cheung |
| 4,776,905 | A | | 10/1988 | Cheung et al. |

(List continued on next page.)

*Primary Examiner*—Stephen F. Gerrity
(74) *Attorney, Agent, or Firm*—Christie, Parker & Hale, LLP

(57) ABSTRACT

A method for welding baling straps and the like includes receiving two strap portions intermediate to weld plates such that the two strap portions overlap at least partially, moving the weld plates back and forth with respect to one another so as to move the two strap portions back and forth with respect to one another, and locking the weld plates while the weld plates are moved back and forth. Locking the weld plates while moving the weld plates back and forth effects the formation of a weld which attaches the two strap portions together. An improved weld plate configuration is also provided. The improved weld plate has an alternating pattern of teeth formed thereon such that portions of the weld plate vary in the ability thereof to grip a strap.

33 Claims, 20 Drawing Sheets

U.S. PATENT DOCUMENTS 4,791,968 A 12/1988 Pearson
4,836,873 A * 6/1989 Mitanihara et al. ..... 100/2
4,951,562 A 8/1990 Ribaldo
4,952,271 A 8/1990 Cheung et al.
4,953,599 A 9/1990 Kato
4,960,968 A 10/1990 Kusakabe et al.
5,006,385 A 4/1991 Cheung et al.
5,024,149 A 6/1991 Kato
5,029,433 A * 7/1991 Werk ..... 100/29
5,078,185 A 1/1992 Angarola
5,087,306 A 2/1992 Cheung et al.
5,238,521 A 8/1993 Cheung et al.
5,267,508 A 12/1993 Yoshino
5,306,383 A 4/1994 Kobiella
5,348,781 A 9/1994 Kobiella
5,350,472 A 9/1994 Kobiella
5,377,477 A 1/1995 Haberstroh et al.
5,400,706 A 3/1995 Tipton et al.
5,546,855 A 8/1996 Van Doorn et al.
5,644,978 A 7/1997 Jaenson et al.
5,673,614 A 10/1997 Jaenson et al.

* cited by examiner

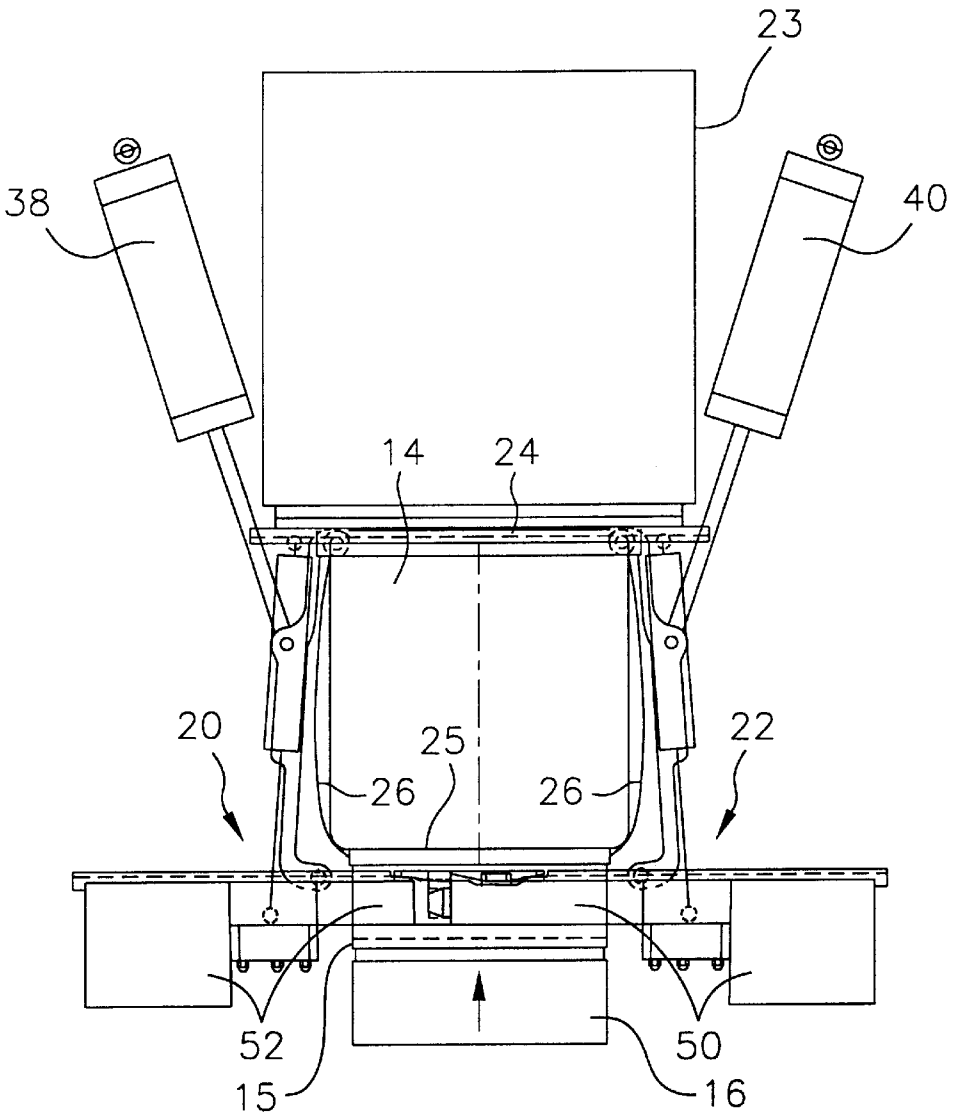
FIG. 9
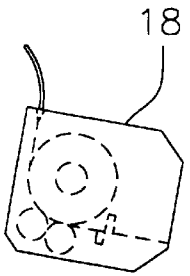

STRAP WELDING SYSTEM AND METHOD

RELATED APPLICATION

This is a continuation-in-part patent application of U.S. patent application Ser. No. 09/493,426, filed Jan. 29, 2000, entitled AUTOMATIC BALE STRAPPING SYSTEM, the entire contents of which are hereby expressly incorporated by reference.

FIELD OF THE INVENTION

This invention relates generally to an apparatus for automatically strapping bales of cotton or other fibers or stacks of lumber or bricks or other items that are suitable for strapping. This invention relates more particularly to a system and method for welding the ends of thermoplastic straps together so as to form bales of cotton or so as to bind together any other desired material or items.

BACKGROUND OF THE INVENTION

In the cotton or fiber industry, the normal method of banding or tying cotton bales has been to have workmen direct a tie, such as a band or wire, around a pressed cotton bale and then secure the ends of the ties appropriately, depending on the design of the tie. In the cotton or fiber industry, there are generally three ways to secure a bale after the bale has been pressed. Pertinent securing means include pre-formed steel wires that have interlocking ends pre-formed to define loops which engage one another during a tying operation, flat ribbon-steel bands which have their ends inserted into a crimp by which they are secured, and flat thermoplastic strapping material, typically formed of polypropylene or polyester, which has its ends welded together.

The steel pre-formed wires have a loop manufactured into each end thereof. The ends are interlocked around to form a square knot. When the pressure is released from the bale, the knot formed by the interlocking loops pulls tight and retains the bale against further expansion. In a conventional bale-tying operation, two workmen (one on each side of the baling press) manually bend the wires around the bale and secure the ends of the wires together in a wire tie guide assembly. The wires are normally tied together sequentially, one at a time.

Alternatively, the wires might be tied in a hydraulically operated wire tying device mounted on a baling press. The hydraulically operated wire tying device ties a plurality of wires having pre-formed interlocking ends around a bale formed in the press. Pivotally mounted wire bending assemblies take the place of workmen on each side of the baling press. The pivotally mounted wire bending assemblies bend the tie wires around the bale by inserting the ends of the tie wires into a wire tie guide assembly. However, workmen are still required to individually load each of a plurality of tie wires into the wire bend assemblies.

Although an improvement over the manual bale tying operation, the hydraulically operated wire tying device still exhibits certain problems which slow the baling process. Exact timing is required for the sequence of events which make up the wire tying operation. If a wire does not follow the correct path at the correct time, several factors can combine to prevent the interlocking ends of the wire from engaging to form a knot.

In particular, the interlocking ends of the wires are conventionally oriented such that the loops are disposed in a generally horizontal plane. This geometric orientation forces the wire closers to be constructed with relatively wide cavities, in order to accommodate the wide aspect ratios of the loops. This, in turn, allows the wires a greater degree of freedom of movement within the cavities. Consequently, there is a greater probability of one wire merely sliding past another, without their loops engaging in a knot.

In addition, press wear, both alone or in combination with component manufacturing tolerances, can cause a follow block to vary its position or orientation both vertically or from side to side. Consequently, the wire bend assemblies may not be in alignment with the wire tie guide assemblies. All of the above-described cases result in mis-ties, with a consequent undesirable loss of time and possible damage to the press.

Bale tying using flat steel straps is hindered primarily by. the cost of the strapping material, the complexity of the machinery used, and the speed at which the machinery is able to operate. In addition, both the weight of steel strap tie material and its substantially sharp edges make it cumbersome and particularly dangerous to handle.

Further, once it is removed from a bale, steel strapping material is not easily recycled by an end user. Removal is difficult, and once removed, a large volume of sharp material must be colleted and crushed together to form the material into a package that can be more easily handled.

Additionally, steel strap tie material is further disadvantageous in that its weakest point (the joint) is located in the highest stress position on the bale. This is true because the forming machinery is only able to apply a joint, i.e., a crimp, on the side of the bale (the position of the bale with the highest degree of lateral pressure or stress). This non-optional position of the crimp results in significant tie breakage with a consequent loss of bale integrity.

Conversely, plastic or non-ferrous strapping is an ideal material for strapping bales of cotton or other fibers. Indeed, such plastic strapping may be used to strap a wide variety of different items, such as lumber or bricks, as well as many other materials which are suitable for such strapping. As those skilled in the art will appreciate, plastic is relatively light in weight and can be formed into a variety of widths and thicknesses. Plastic also has comparatively soft or non-sharp edges which allows for easy handling. Its reduced weight lowers shipping costs. This plastic or non-ferrous strapping material is very competitive with both wire ties and metal strapping, on a cost per bale basis. Further, plastic strapping is easily adaptable to fully automatic welding machinery. Plastic strapping material is readily recyclable by the end user and is considered substantially safer than steel strapping material, particularly in instances of strap breakage wherein the sharp edges of the steel strapping frequently move violently and dangerously in response to breakage.

Because of the particular orientation of conventional plastic strap automatic tying machinery, certain disadvantages arise when one adapts strapping and joint forming apparatus to the structure of a baling press. Typically, automated thermoplastic strapping machinery, including a material feeder, tensioner, cutting shear and joint former, are so large that they are precluded from being able to be placed anywhere except on the side of the bale. As was the case with steel strapping material discussed above, thermoplastic strapping joint formation therefore takes place in the region of the bale that exhibits the highest degree of tensile stress.

In this regard, conventional thermoplastic strapping machinery must typically wait until a baling press has completed operation and has reached "shut height" before it begins the strapping operation. The strapping head pulls strapping material off of a spool and directs it around the bale through a series of shoots, until the front edge of the strapping material has completed its circuit of the bale and is directed back to the region of the strapping head. The strap is then pulled tight around the bale to a pre-determined tension and the strap is then cut with a shear. The two ends are then joined by a friction weld, hot knife weld, or other similar joint forming operation, and maintained together until the joint is cool, in which time the strap is released and allowed to carry the tensile load of the bale.

Referring now to FIGS. 1*a*, 1*b* and 1*c*, there is shown a semi-schematic view of cotton, or other fibers, being pressed into a bale 14 between the platens 24 and 25 of a hydraulic press 16, 23 in accord with the prior art. Typically, fiber is pressed by a large hydraulic cylinder out of a box that measures approximately 30 inches wide by 54 inches long and 144 inches deep. Such a box is typically filled with approximately 500 pounds of cotton lint which is subsequently pressed into a 20 inch by 54 inch bale 14 measuring approximately 20 to 22 inches tall (in accordance with the illustration of FIG. 1*a*). The box from which the bale 14 is pressed has been omitted for the sake of illustrational clarity.

Strapping material, in the form of thermoplastic straps 26, is inserted through guide slots in the upper 24 and lower 25 platens, and are secured on the sides of the bale 14 (as shown in the illustration of FIG. 1*b* ). Once the bale 14 is tied, the press 16, 23 is released and the bale 14 is free to expand to the constraints of the straps 26. As shown in the illustrated embodiment of FIG. 1*c*, the bale 14 is then dumped out of the press 16, 23, making way for a subsequent box loaded with an additional 500 pounds of cotton lint for pressing into the next bale.

It should be noted that conventional thermoplastic strapping systems typically consist of three laterally spaced-apart strapping heads, such that the unit must be indexed in order to tie the requisite number of straps (typically 6) about a bale 14. Should the baling press leak down slightly (a typical artifact of cotton presses) the compressed bale would tend to grow as the press platens separated. When an indexing strapper is used, typically the #1, #3 and #5 straps are tied first. Five to ten seconds later, the strapping head is indexed and the #2, #4 and #6 straps are tied. In the event of press leakage, the first three straps are pulled tight around a smaller diameter bale. The second three straps are subsequently pulled tight around a bale that has expanded and are therefore not as tight. This causes the first three straps to be subject to substantially greater pressure than the second set. These ties are more prone to exceed yield strength and fail which typically causes total strap failure as pressure promptly increases for the ties of the second set.

Accordingly, an apparatus (and process) for tying bales with a flexible thermoplastic strapping material, that is designed for efficient, repeatable operation with low joint stress is needed. Such an apparatus should be designed for easy operation by a single workman to reduce labor costs, while at the same time being easy to install or retrofit to existing presses. Such an apparatus should further be mountable to operate in conjunction with a press such that ginning speed is increased by incorporating the tying process into the last few seconds of the bale pressing operation, thus eliminating the separate indexing and tying steps conventionally undertaken at the end of the process.

SUMMARY OF THE INVENTION

The present invention specifically addresses and alleviates the above-mentioned deficiencies associated with the prior art. More particularly, the present invention comprises a method and apparatus for welding baling straps and the like. Two strap portions are received intermediate two weld plates such that the two strap portions overlap one another at least partially. The weld plates are moved back and forth with respect to one another, so as to similarly move the strap portions back and forth with respect to one another. As those skilled in the art will appreciate, such movement of the strap portions back and forth with respect to one another generates a substantial amount of heat. The resulting friction softens the interfacing region of the two strap portions so as to facilitate welding thereof.

According to one aspect of the present invention, the weld plates are rocked while the weld plates are moved back and forth. Rocking the weld plates while moving the weld plates back and forth effects the formation of a weld which attaches the two strap portions together in a manner having enhanced tensile strength.

According to another aspect of the present invention at least one, preferably both, of the weld plates comprises a base having a plurality of teeth formed thereon. At least a portion of the teeth formed upon the base are configured so as to grip a strap. The teeth are formed so as to define a longitudinally alternating pattern according to which portions of the weld plate vary in the ability thereof to grip the strap. Thus, some portions along the length of a weld plate grip the strap securely, while other portions along the length of the weld plate facilitate at least some longitudinal movement of the strap with respect to the weld plate. By providing alternating portions of the weld plate which alternately grip and allow movement of the strap, additional movement of the strap is facilitated which results in enhanced tensile strength of the weld.

BRIEF DESCRIPTION OF THE DRAWINGS

These and other features, aspects, and advantages of the present invention will be more fully understood when considered with respect to the following detailed description, appended claims, and accompanying drawings, wherein:

FIG. 9 is a is a semi-schematic end view of the automatic bale strapping system, at a sixth stage in the strapping operation, with the strapper heads in welding position and the strap being welded;

DETAILED DESCRIPTION OF THE INVENTION

Figure 3A:
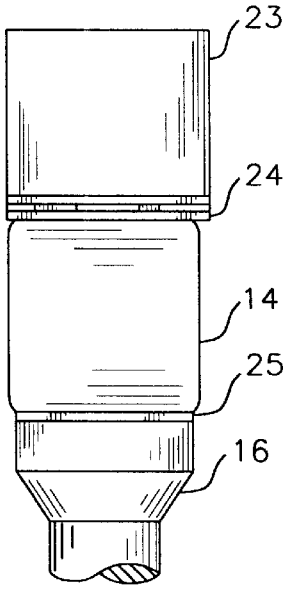
FIG. 3*a* is a simplified illustration of a bale being formed by a hydraulic press.
Figure 3B:
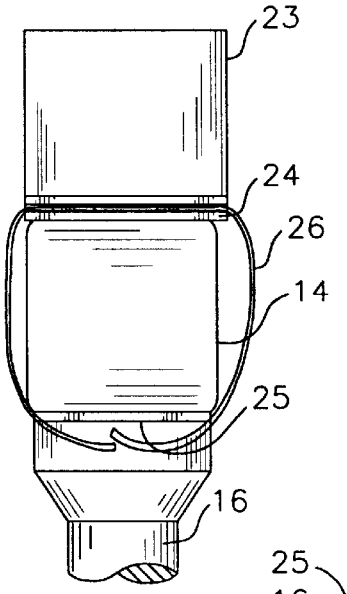
FIG. 3*b* is an illustration of a formed bale within a hydraulic press with thermoplastic straps inserted through the press and secured on the bottom (or top) of the bale.
Figure 3C:
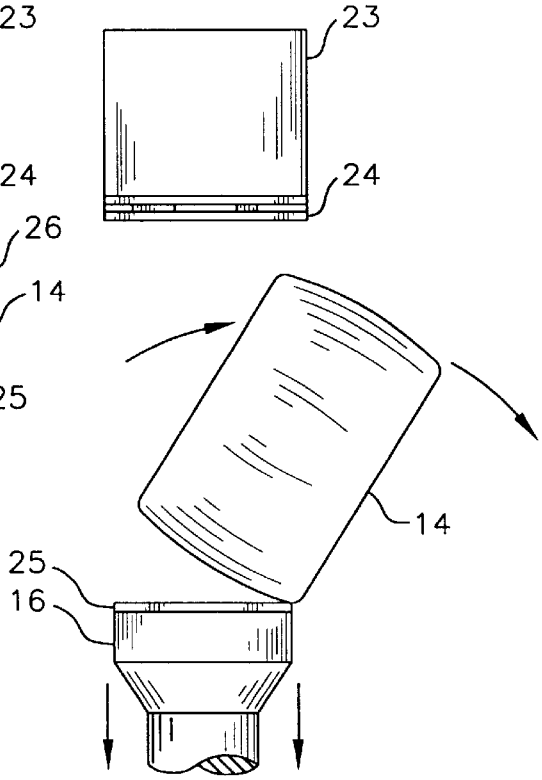
FIG. 3*c* is an illustration of the hydraulic press platens being released with the bale free to expand to the constraints of the strap and being ejected from the press.

Referring now to FIGS. 3*a*, 3*b* and 3*c*, there is shown a semi-schematic view of cotton, or other fibers, being pressed into a bale 14 between the platens 24, 25 of a hydraulic press 16, 23. Typically, fiber is pressed by a large hydraulic cylinder out of a box that measures approximately 30 inches wide by 54 inches long and 144 inches deep. Such a box is typically filled with approximately 500 pounds of cotton lint which is subsequently pressed into a 20 inch by 54 inch bale measuring approximately 20 to 22 inches tall (in accordance with the illustration of FIG. 3*a*). The box from which the bale is pressed has been omitted for the sake of illustrational clarity.

Strapping material, in the form of thermoplastic straps 26, is inserted through guide slots in the upper 24 and lower 25 platens, and are secured on the bottom (or top) of the bale 14 (as shown in the illustration of FIG. 3*b*). Once the bale 14 is tied, the press is released and the bale is free to expand to the constraints of the straps. As shown in the illustrated embodiment of FIG. 3*c*, the bale is then dumped out of the press, making way for a subsequent box loaded with an additional 500 pounds of cotton lint for pressing into the next bale.

Figure 1A:
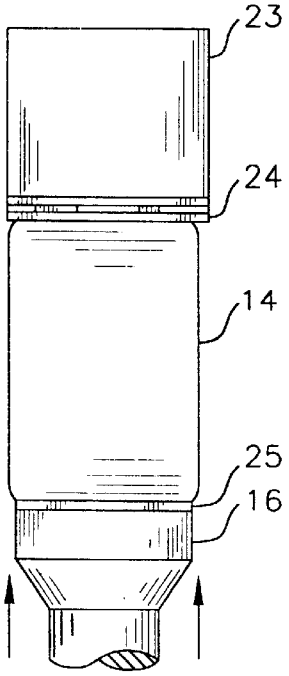
FIG. 1*a* is a simplified illustration of a bale being formed by a hydraulic press.
Figure 1B:
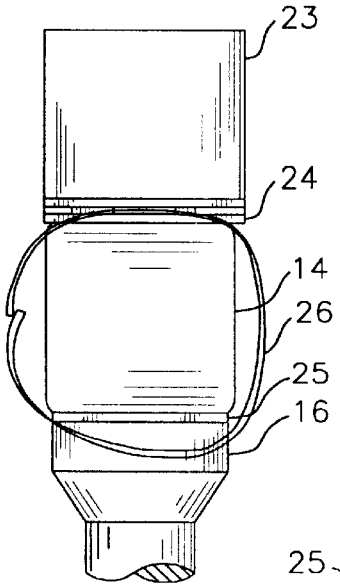
FIG. 1*b* is an illustration of a formed bale within a hydraulic press with thermoplastic straps inserted through the press and secured at about the mid-bale position.
Figure 1C:
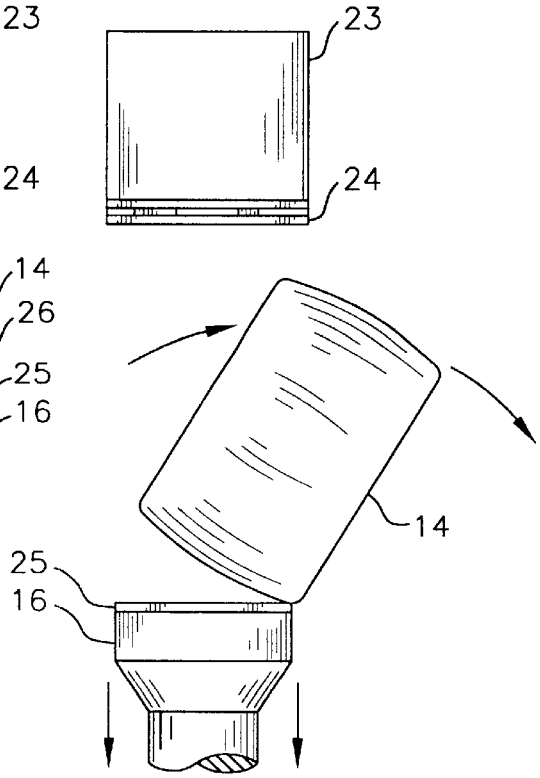
FIG. 1*c* is an illustration of the hydraulic press platens being released with the bale free to expand to the constraints of the strap and being ejected from the press.
Figure 2:
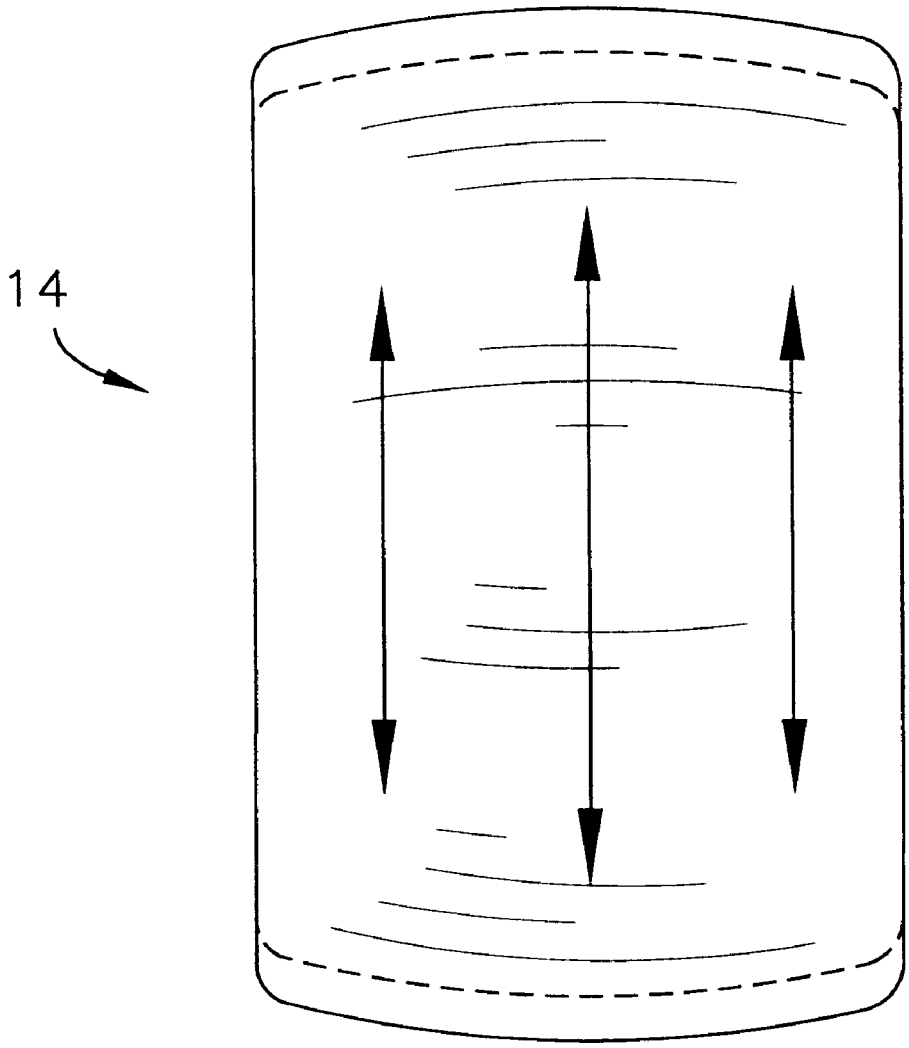
FIG. 2 is a semi-schematic end view of a compressed bale illustrating its expansion characteristics.

Referring now to FIG. 2, it should be understood that securing the baling straps on the bottom (or top) of the bale 14 allows the joint to be formed in a region of the bale where there is little or no stress in a direction parallel to the strap. In contrast to the prior art placement of the joint along the side of the bale, placing the joint on the bottom (or top) portion of the bale results in stress forces acting in a direction normal (or perpendicular) to the joint rather than parallel to the joint. This particular joint placement results in an approximately 20% to 35% joint stress decrease when compared to the prior art placement.

Accordingly, the bale tie strength may be seen to be up to the near maximum breaking strength of the strap since only uninterrupted strapping material is positioned in the high stress areas along the sides of the bale. Additionally, because of its placement, the joint knot recedes within the cotton product, as the bale expands to the constraints of the straps, such that the joint is not able to present a "sharps" to burlap bagging material, making the bales more easily and consistently bagable.

As will be described in greater detail below, all of the straps are tied in a single operation and all of the strap lengths are substantially uniform, such that tied bales are reasonably consistent in size and shape regardless of the weight, grade or moisture content of the baled cotton or other fibers. Accordingly, it can be understood that storage and shipping are rendered more efficient due to the improved stackability resulting from consistent and uniformly sized bales that can be obtained from practice of the present invention.

As will additionally be described in greater detail below, the strap feeder apparatus and cutting shears are able to operate while the press is still dropping, or while cotton boxes are being rotated into position for pressing. Neither of the aforementioned apparatus are high speed mechanisms, nor are they required during the physical strapping operation. Due to the structure and operation of the automatic bale strapping system in accordance with the invention, no separate tensioning device is required, making the strapping machinery system substantially less complex and bulky than one which is required to operate within a "strap time window" between completion of the bale pressing operation and subsequent bale removal from the press. In accordance with the present invention, the automatic bale strapping system incorporates the strap wrapping and joint formation operations into a single mechanism which is rotated beneath the bale so as to form the joint in the proper position. Due to the substantial size and complexity reduction of the system, the entire plurality of straps are put onto a bale at one time, in a single operation.

Figure 4:
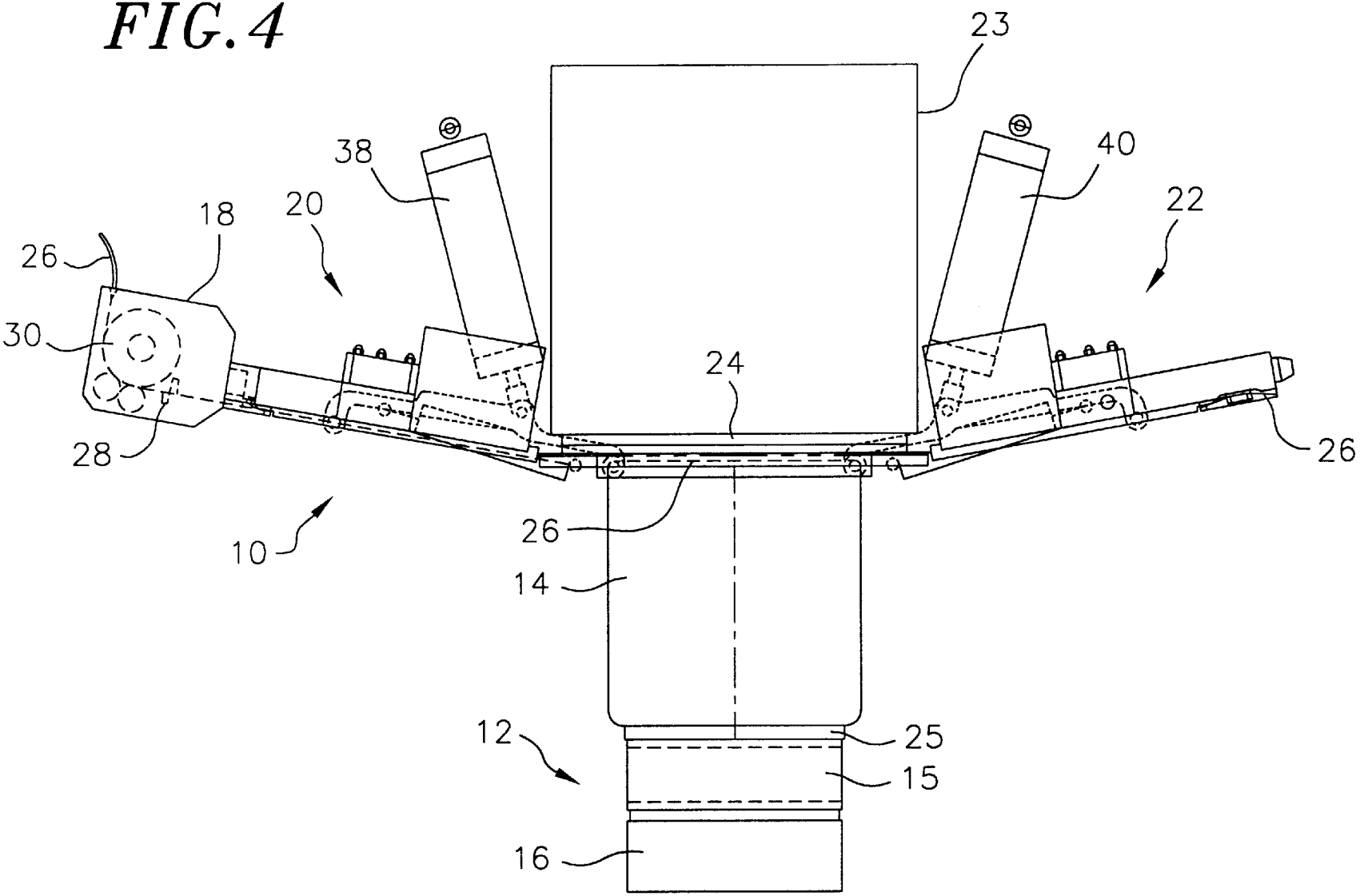
FIG. 4 is a semi-schematic end view of an automatic bale strapping system according to the invention, at a first stage in the bale strapping operation, with the feeder in place to feed strapping material across the apparatus and precut the strap.

Turning now to FIG. 4, there is shown a semi-schematic view of the side (or end) of a working embodiment of an automatic bale strapping system 10, provided in accordance with the invention, mounted on a cotton baling press 12. For clarity of illustration, the press 12 is shown in simplified view and with the front and back doors, typically provided on the baling chamber of such presses, omitted for the sake of illustrational clarity. The press 12 is depicted in open condition so as to provide access for tying a bale 14 compressed in the baling chamber by means of a moving press ram 16.

As is described in greater detail below, the automatic bale strapping system 10 is useful for tying a plurality of straps around a bale, such as bale 14, after the bale has been formed in the baling chamber. It is important to note that a separate, dedicated bale strapping system 10 is provided for each strap to be formed around a bale. If desired, the system 10, provided in accordance with this invention, can be adapted to tie any number of straps circumferentially around the outside surface of the bale, but preferably is adapted to tie either 6 or 8 straps. In addition, although the bale strapping system 10 is described with particular reference to a cotton or fiber baling operation, it can be adapted for tying bales or stacks of other suitable materials as well.

A key feature of the bale strapping system 10 is that it is designed to be loaded with strapping material from a spool of such material (not shown) which is directed by a feeder 18 into the system from the front side of the press. For purposes of explanation herein, the front side of the bale strapping system is termed the "feeder" or "load" side while the back (or opposite) side is termed the "joint" or "weld" side.

An additional feature of the automatic bale strapping system 10 provided in accordance with the invention, is that it is designed to be affixed to, and used in combination with, either a conventional or a down-packer type cotton baling press. As will be described in greater detail below, particular features of the bale strapping system 10 allows for automatic tying of a plurality of thermoplastic straps around a cotton bale without the mechanics of the system interfering with the normal motion of either the press or the box loader turntable baseplate.

The bale strapping system 10 comprises two separate assemblies which operate together to automatically position and join together a plurality of thermoplastic straps around the bale 14. A first, strap assembly 20 and a second, weld arm assembly 22 are pivotally mounted on opposite sides of a center plate 24 which might, in turn, be affixed to or form part of the upper platen of the press 12. The strapper assembly 20 is mounted on the load side of the press while the weld arm assembly 22 is mounted on the weld side, as shown in the exemplary embodiment of FIG. 4. The bottom surface of the center plate 24 might form the roof of the baling chamber and would thereby provide one of the surfaces against which the bale 14 is compressed. The center plate 24 is provided with elongated, slotted channels formed in its bottom surface. The channels are open ended and extend from the front to the back side of the center plate 24 across its width. The straps when loaded into the bale strapping system 10 extend from the strapper assembly 20 to the weld arm assembly 22 through the channels. The straps exit the channels through the slots during the bale strapping operation, such that the completed bale can be removed from the press.

In the illustrated embodiment of FIG. 4, strapping material 26 is directed by the feeder assembly 18 into a slot or shoot provided for such purpose in the strapper assembly 20. Thence, the strapping material 26 is directed through the channels extending through the center plate 24 and into corresponding channels or chutes disposed in the weld arm assembly 22. As will be described in greater detail below, once the strapping material reaches the end of the weld arm assembly 22, cutting shears 28 disposed within the feeder assembly 18, cut the strap to a uniform, repeatable length.

Length reproducibility can be accomplished in a variety of ways. In particular, the feeder control wheel 30 might be provided with an electronic or mechanical counter, such that the feeder ceases feeding after a specific and pre-determined amount of material is directed therethrough. Alternatively, the weld arm assembly 22 might be provided with an abutment stop such that the strap can travel so far into the weld arm assembly until it butts up against the stop and can move no farther. At that point, a clutch sensor in the feeder assembly 18 would cause the feeder to cease operating and the cutting shears 28 operate to slice the strap to a repeatable length.

Once the foregoing operations are concluded, and all of the straps have been inserted and cut to length, the automatic bale strapping system 10 might be considered to be in a "loaded" condition. During this time, the bale 14 is being formed in the baling chamber and the press doors are closed. In the case where a plurality of bale strapping systems are disposed along the length of a press (and thus the bale) these operations are performed simultaneously.

Figure 5:
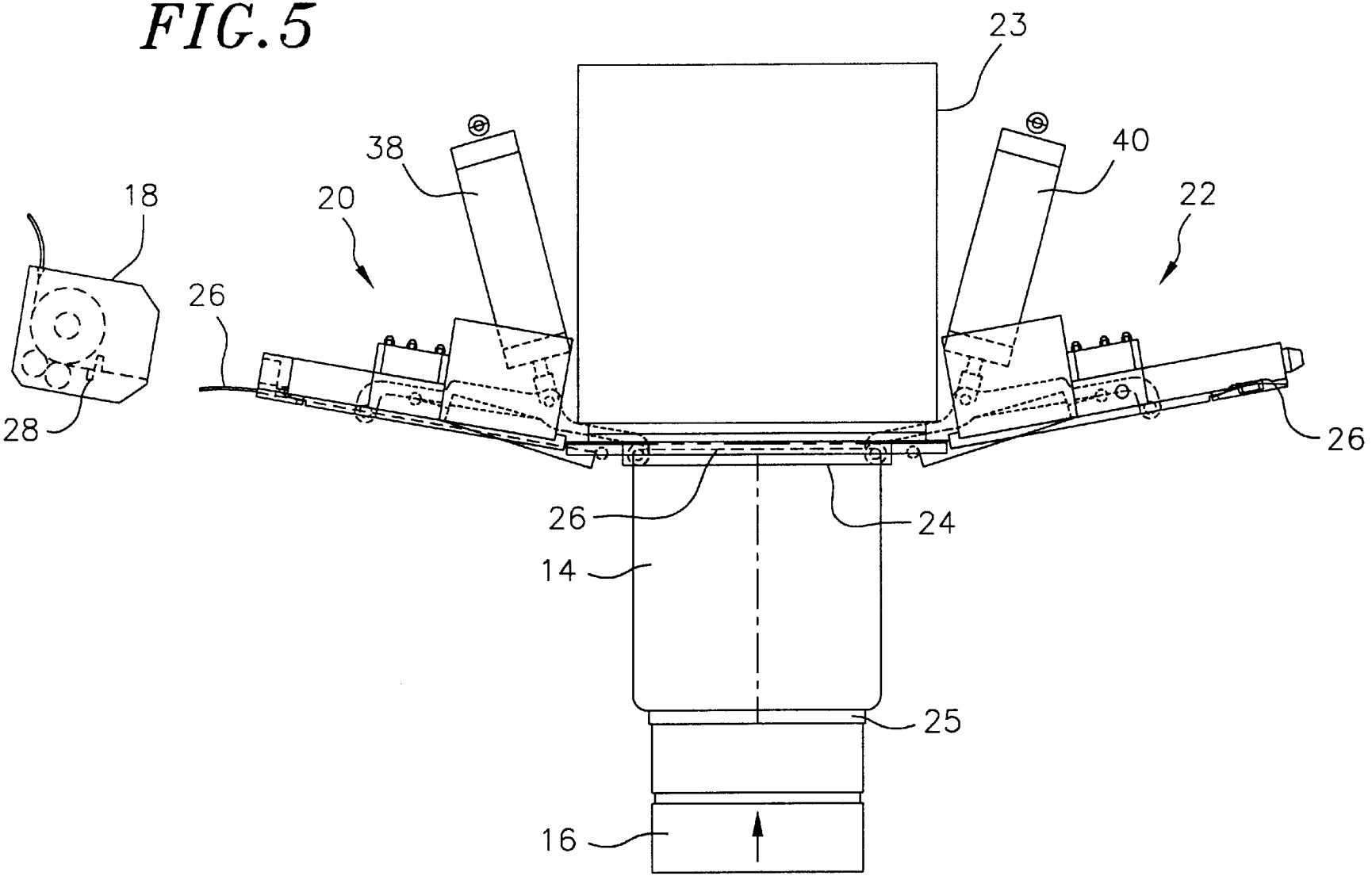
FIG. 5 is a semi-schematic end view of the automatic bale strapping system, at a second stage in the strapping operation, with the feeder moved back and the strapping material locked into the strapper.

Referring now to FIG. 5, once the strapping material 26 is pulled off the spool by the feeder unit 18 and fed across the apparatus through the channels and chutes, the feeder unit 18 stops. Strapping material 26 is locked into place in the strapper assembly 20 and the weld arm assembly 22 by hydraulically operated clamps positioned near the outboard ends of each of the assemblies. The strap is then cut to the desired length by the cutting shear 28. Next, the feeder assembly 18 is displaced from its position proximate to the strapper assembly 20 a distance sufficient to expose the cut end of the strapping material 26 which protrudes from the outboard end of the strapping assembly 20. The automatic bale strapping system 10 is now ready to being the tying operation, even though the press ram 16 is still moving to compress the bale 14.

Figure 6:
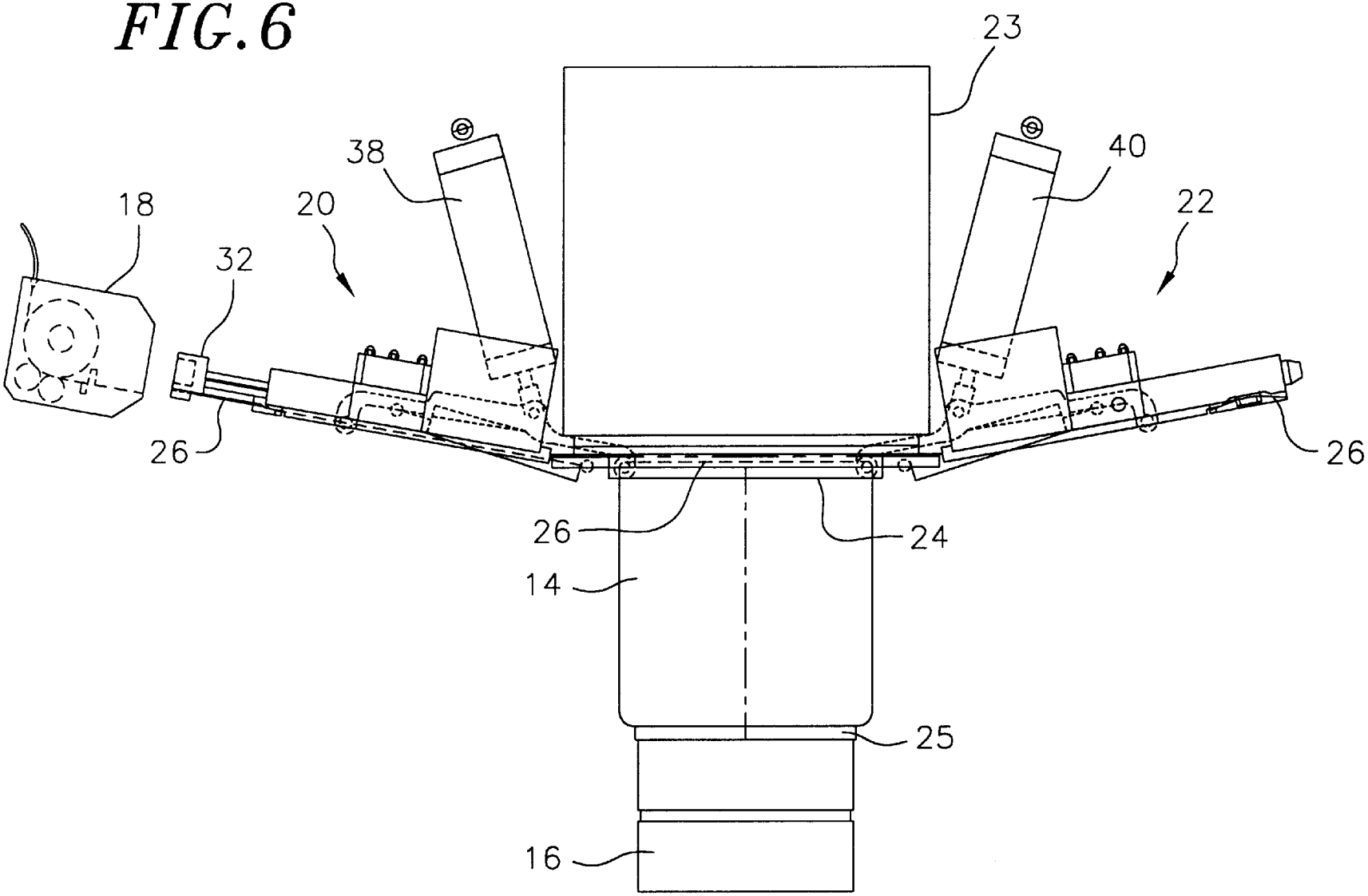
FIG. 6 is a semi-schematic end view of the automatic bale strapping system, at a third stage in the strapping operation, with the strapper tip support moved out to protect the strap during positioning to weld.

Turning now to the exemplary embodiment of FIG. 6, after the feeder assembly 18 is displaced from the strapper assembly 20, a strapper tip support sled 32 is hydraulically extended from the body of the strapper assembly 20 in order to cover the cut end of the strapping material 26 that had previously extended beyond the outboard end of the strapper assembly 20, as depicted in the exemplary embodiment of FIG. 5. The strapper tip support sled 32 functions to support the end of the strapping material 26 and subsequently guide its end of the strapping material 26 into precise registration with the other end of the strapping material held in the weld arm assembly 22. In accordance with the invention, the strapper tip support sled 32 not only protects the strap tip during positioning, but also positions and guides the strap tip during joint formation, as will be described in greater detail below.

Figure 7:
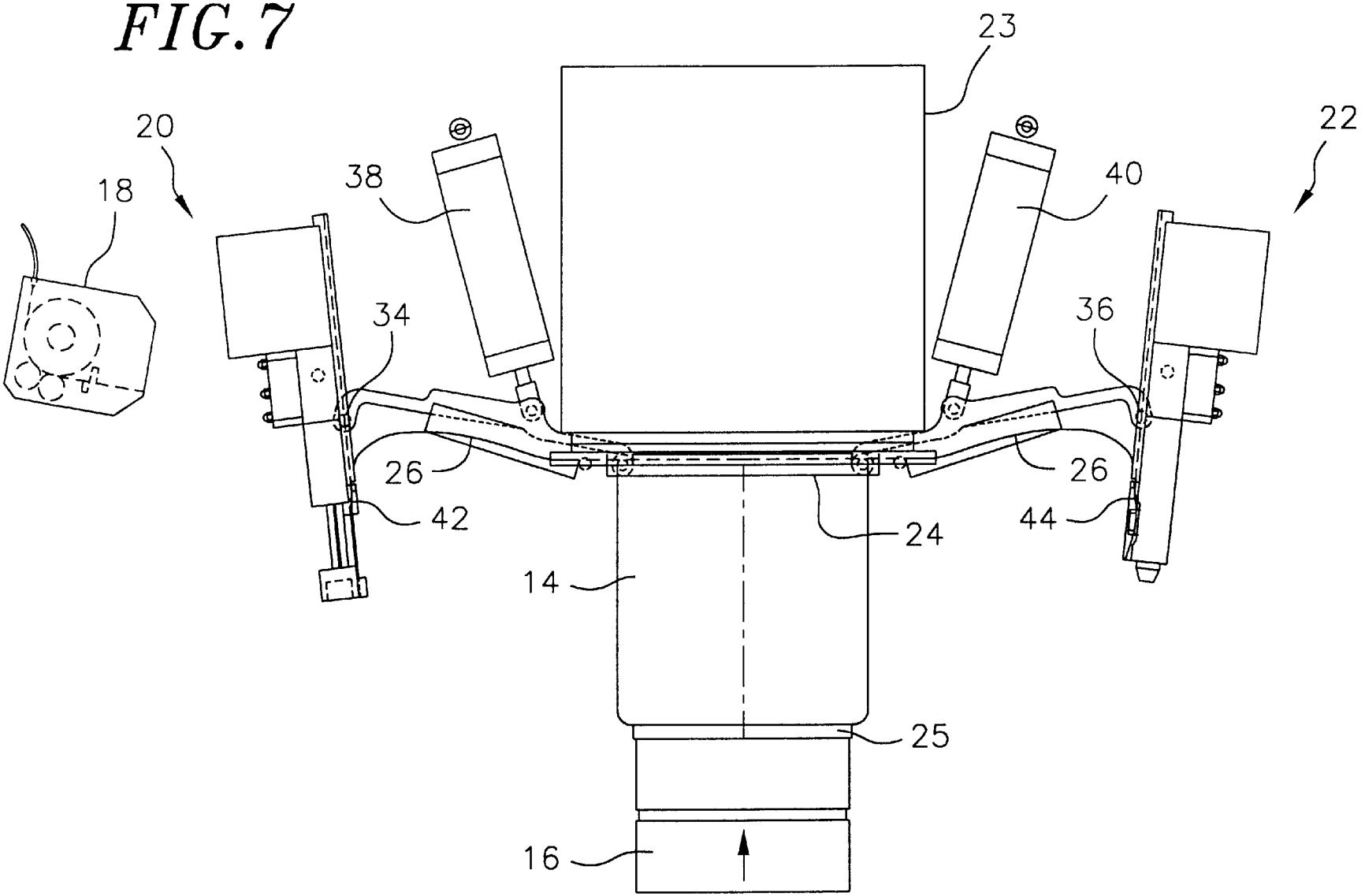
FIG. 7 is a is a semi-schematic end view of the automatic bale strapping system, at a fourth stage in the strapping operation, with the strapping heads bent down and the strapping material released from the loading shoot.

Turning now to the exemplary embodiment of FIG. 7, as the press ram 16 continues to compress the bale 14 the strapper assembly 20 and weld arm assembly 22 are pivoted from their loading orientation into their tying orientation. Both the strapper assembly 20 and weld arm assembly 22 are rotated about respective pivot points 34 and 36 by corresponding hydraulic cylinders 38 and 40. Prior to rotation, the loading chutes disposed along the bottom of the assemblies are caused to open, thereby allowing the strapping material 26 to fall free of the assemblies except where they are held withing each assemblies outboard end by a mechanical pressure or "pinch" lock 42 and 44, respectively. Both the strapper assembly 20 and weld arm assembly 22 are now bent down with the strapping material locked into place and the strap chute doors in the open position. It should further be understood that this operation takes place while the press ram 16 is still moving in order to compress the bale 14.

Figure 8:
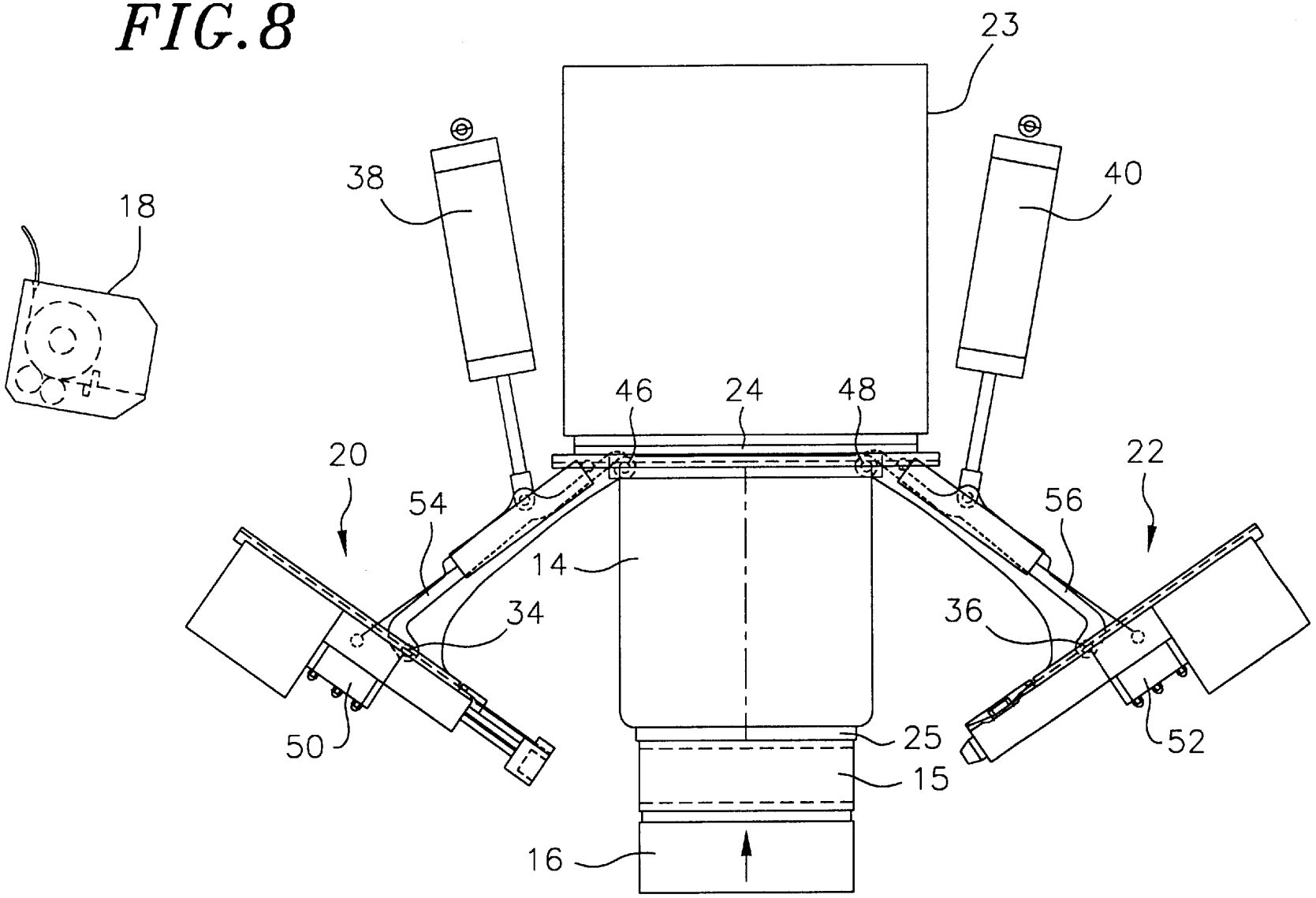
FIG. 8 is a is a semi-schematic end view of the automatic bale strapping system, at a fifth stage in the strapping operation, with the strapping heads moved into the pre-tie position.

Turning now to FIG. 8, the exemplary embodiment shows the strapper assembly and weld arm assembly 22 being moved into the pre-tie position as the press ram 16 completes the bale pressing operation. Both the strapper assembly and weld arm assembly are rotated about respective pivots 46 and 48 by the respective hydraulic cylinders 38 and 40. In this regard, each of the arm assemblies 20 and 22 include a respective finger assembly 50 and 52, termed the strapper finger assembly and the weld arm finger assembly herein. Each finger assembly is coupled to the center plate 24 by respective arms 54 and 56 which are pivotally coupled to the center plate 24 at pivot points 46 and 48, respectively, and each of which is further pivotally coupled to its respective finger assembly at pivot points 34 and 36 respectively. Pneumatic cylinders 38 and 40 are connected to each arm 54 and 56 for pivoting the arms and, thus the strapper assembly 20 and weld arm assembly 22 from their fully raised positions to their fully lowered positions.

With reference now to the exemplary embodiment of FIG. 9, the strapper and weld arm finger assemblies 50 and 52 have been inserted into receiving channels provided in the follow block 15, such that their outboard ends are in contact with one another and with the strapping material 26 held by the strapper assembly 20 having been inserted into the welding channel of the weld arm assembly 22, in a manner to be described in greater detail below. In particular, as the strapper finger 50 comes into contact with the weld arm finger 52, the front edge of the weld arm finger butts up against the strapper tip support sled 32 and forces the sled back into the body of the strapper assembly, thereby exposing the strapping material previously protected by the sled. As the tip of the weld arm finger 52 continues to push the sled 32 back into the body of the strapper finger, it receives the exposed strapping material into a guide chute which is provided in registry with the sled such that the weld arm finger slides over the exposed strapping material until the sled 32 is fully pushed back into the body of the strapper finger and the supported strapping material end is fully inserted into the weld arm finger.

As can be understood from the exemplary embodiment of FIG. 9, the thermoplastic strapping material 26 has now been formed around the compressed bale 14 with the ends of the strapping material 26 positioned beneath the bale for welding, as opposed to being positioned along the bale's sides. Since the majority of the operations described in connection with the embodiments of FIGS. 4 through 9 can be performed while the press ram 16 is still moving to compress the bale 14, it should be understood that this results in a significant reduction in the time required to press and strap a bale. The only additional time necessary for operation of the automatic bale strapping system according to the invention, is the time required to move the strapper and weld arm assemblies from their pre-tie positions as illustrated in FIG. 8 to their fully closed and weld positions as illustrated in FIG. 9. Strapping material 26 is initially pre-cut to a specified length and pre-loaded into the system regardless of the state of the press or how far along the press is during the baling operation. Because each of the straps are initially pre-cut to the same specified length, all of the straps disposed along the length of the bale are substantially the same, forcing the shape of the bale to remain substantially uniform along its length, in response. Being of uniform length, each of the straps is subject to a substantially similar amount of stress, such that no one strap, or set of straps, is taking a greater load than any other. The possibility of stress induced failure is therefore greatly minimized.

Further, the symmetrical arrangement of the component assemblies of the automatic bale strapping system across the front and back sides of the baling press and its pivotal connection to the stationary top plate of the press, allows the system to be loaded and articulated into a variety of pre-tied positions without interfering with intermediate operation of the press. All that is required is that the press complete the pressing operation while the outboard ends of the strapper and weld arm finger assemblies are poised to enter the follow block, with follow block entry and strap welding operations proceeding as soon as the press ram reaches a particular spatial location and activates a limit switch, for example.

Naturally, once the strap tips have been juxtaposed within the weld arm finger assembly 52, the overlapped ends are welded together, the locks released and the finger assemblies retracted from beneath the bale by the hydraulic cylinders 38 and 40 until they once again reach the load position illustrated in FIGS. 4 and 5. The feeder assembly 18 is moved into position against the strapper assembly 20, a new length of strapping material 26 is fed across the system and cut to length. The feeder assembly 18 is then again retracted and the system is ready to apply straps to the next bale.

As discussed in detail below, each strap 26 is maintained in a loose configuration around the bale until after the two ends of the strap have been welded securely to one another. Then, the press is moved so as to allow the bale to expand and the straps tighten around the bale as the bale expands.

A particular advantageous feature of the automatic bale strapping system of the invention is its ability to engage in the strapping operation while the press ram is still moving. In particular, both the strapper and weld arm finger assemblies are poised to enter corresponding slots in the follow block 15 during the last few inches of press ram travel. As has been described above, both of the finger assemblies are pivoted into position by corresponding swing arms 54 and 56 controlled by corresponding hydraulic cylinders 38 and 40. However, it should be understood that the respective fingers need to be aligned with one another at the completion of the tying process in order that strapping material disposed within the strapper finger 50 be correctly inserted into the weld arm finger 52. As the strapper and weld arm assemblies are pivoted downwardly from their fully raised to their fully lowered positions, the strapper and weld arm fingers are thereby swung in an arcuate fashion, to an angular position such that their respective outboard tips contact one another in the respective closer cavities of the follow block.

Figure 10A:
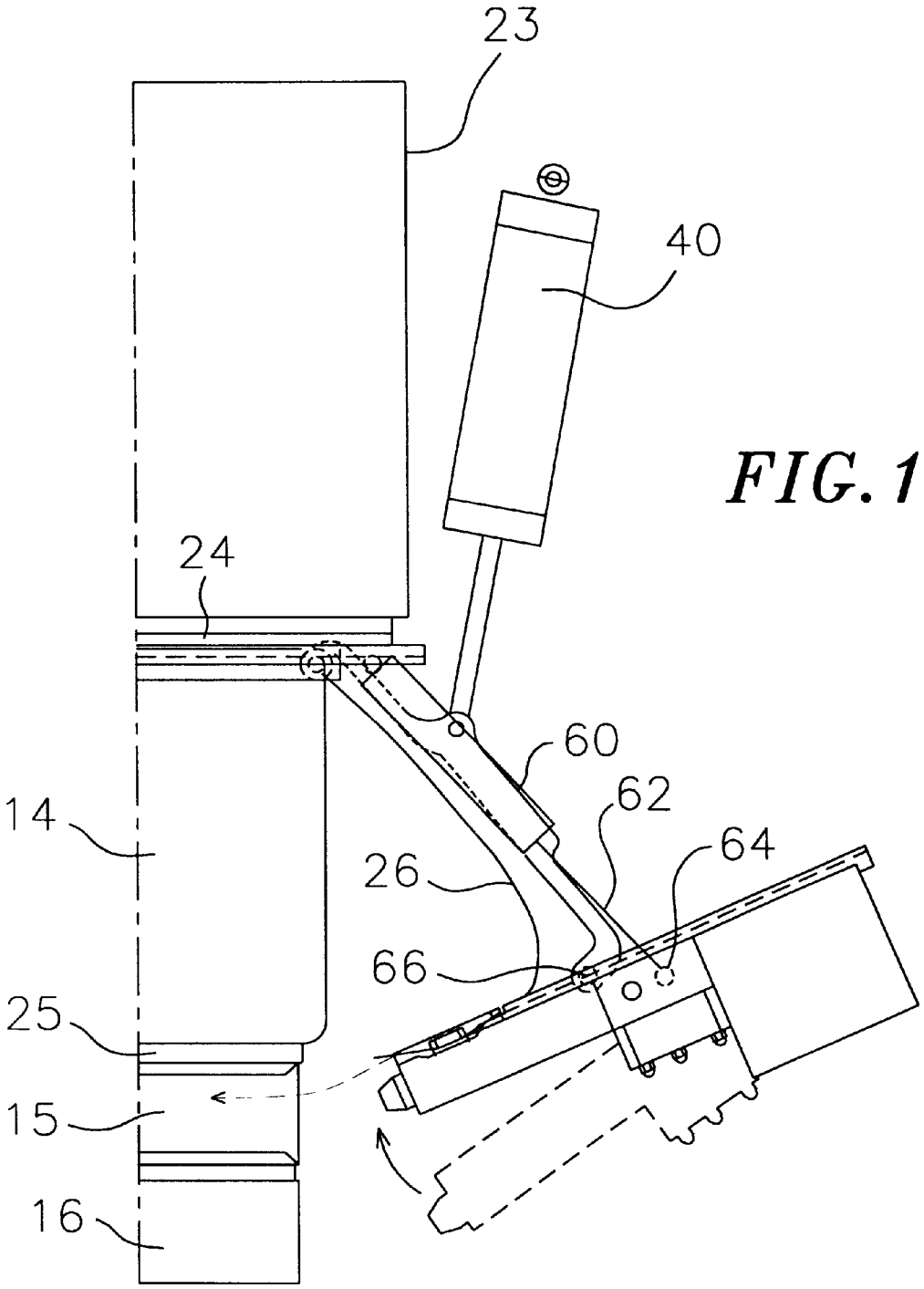
FIG. 10*a* is a semi-schematic cross-sectional view of a level arm positioning system according to the invention positioning a weld arm finger for insertion into a follow block closure cavity.

Referring now to FIGS. 10*a, b* and *c*, each of the finger assemblies are guided into proper position in their respective closer cavities by a level arm assembly 60. The level arm assembly 60 suitably comprises a hydraulic cylinder pivotally coupled to the center plate 24 and an actuator arm 62 extending from the cylinder to a pivot point 64 on each respective finger assembly. Once each of the finger assemblies are free to enter their respective follow block cavities, the level arm assembly 60 functions to apply a torque to each finger assembly which, in turn, forces each finger assembly attached thereto into the same angular aspect with respect to the follow block 15 and, consequently, to mirror image angular aspects with respect to one another. The action of the level arm assembly 60 thereby controls the angular position of each of the finger assemblies as they travel along the follow block closer cavity. Once each finger assembly's outboard end (or tip) enters each respective closer cavity, the geometry of each level arm assembly's pivot point 64 maintains each respective finger assembly in level position through its final travel motion. The geometrical placement of the level arm assembly pivot point 64, outboard each finger assembly's rotational pivot point 66 ensures that each respective finger is suspended in the correct position within the closer cavity for eventual engagement with the tip of the other finger assembly and, thereby eventual engagement of the opposing tips of the strapping material 26, in a manner to be described more fully below.

In operation, the level arm assembly 60 is allowed to "float" until the strapper assembly and weld arm assembly have been lowered and their respective finger assemblies rotated into the pre-tie position, as illustrated in FIG. 10*a*. For purposes of illustrational clarity, only the backside, or weld arm assembly side, of the system is shown. It should be understood that a corresponding level arm assembly is provided on the strapper assembly and functions, in mirror image fashion, to control the strapper assembly in the same manner as level arm assembly 60 controls the weld arm assembly in FIGS. 10*a, b*, and *c*.

Figure 10B:
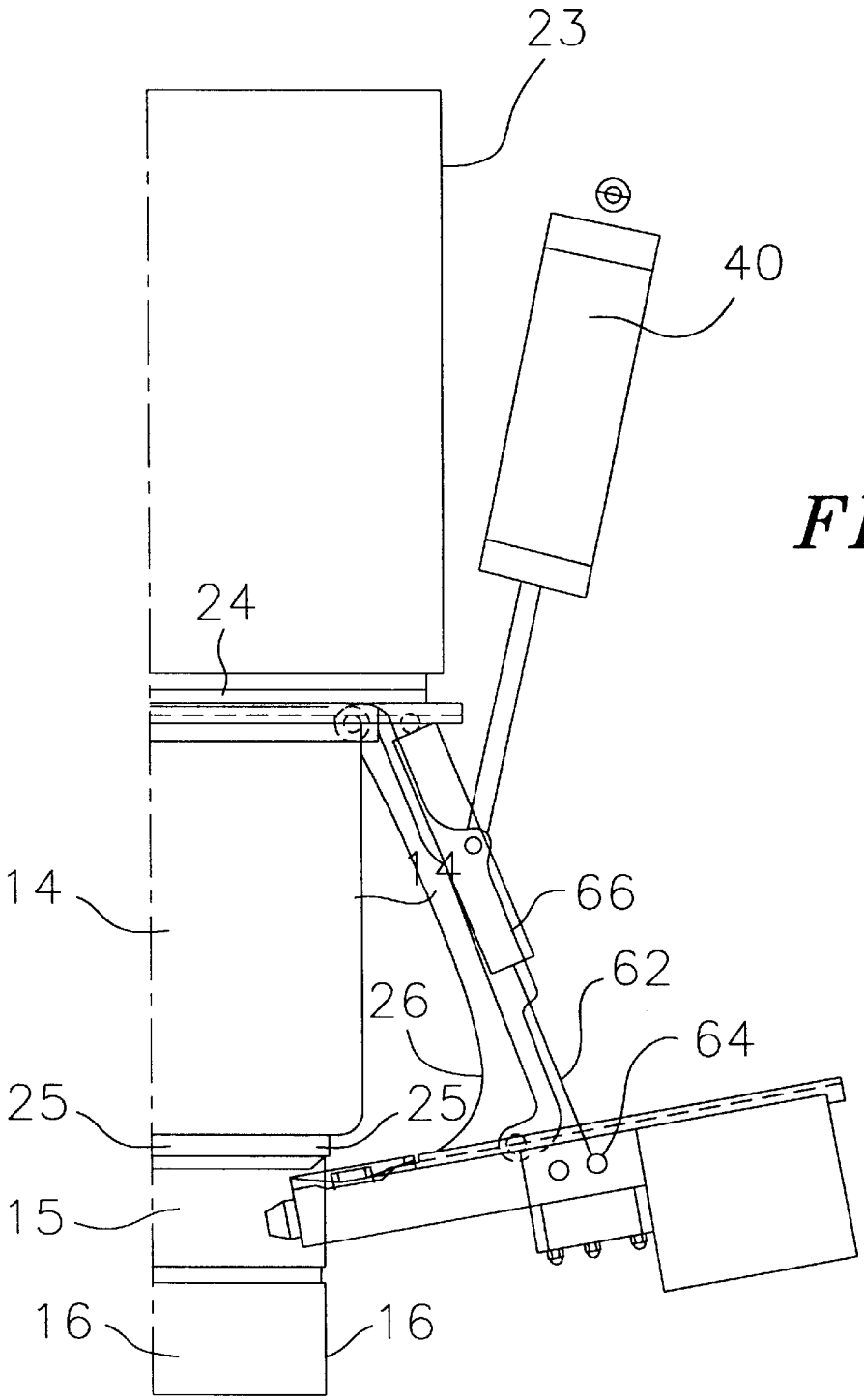
FIG. 10*b* is a semi-schematic cross-sectional view of a level arm positioning system at a second stage in the weld arm finger insertion process.

Turning now to FIG. 10*b*, as the press ram continues to compress the bale, the follow block structure 15 continues to move upwardly in response to pressure from the press ram. The weld arm finger assembly 52 is rotated into its respective closer (or weld) cavity within the follow block 15. At this particular juncture, the finger assembly 52 is rotated by the level arm assembly 60 in a slightly clockwise direction (from the perspective of FIG. 10*b*) in order to present a shallow acute aspect angle to the follow block 15 in order that the finger assembly tip might easily enter the follow block closure cavity along a relatively linear travel path, as opposed to an arcuate one. Adjusting the presentation angle of the finger assembly tip with respect to the follow block allows the finger assembly tip to be guided in a linear fashion into the closure cavity as opposed to an arcuate one which would necessitate the closure cavity being large enough to accommodate a radiused travel path.

Figure 10C:
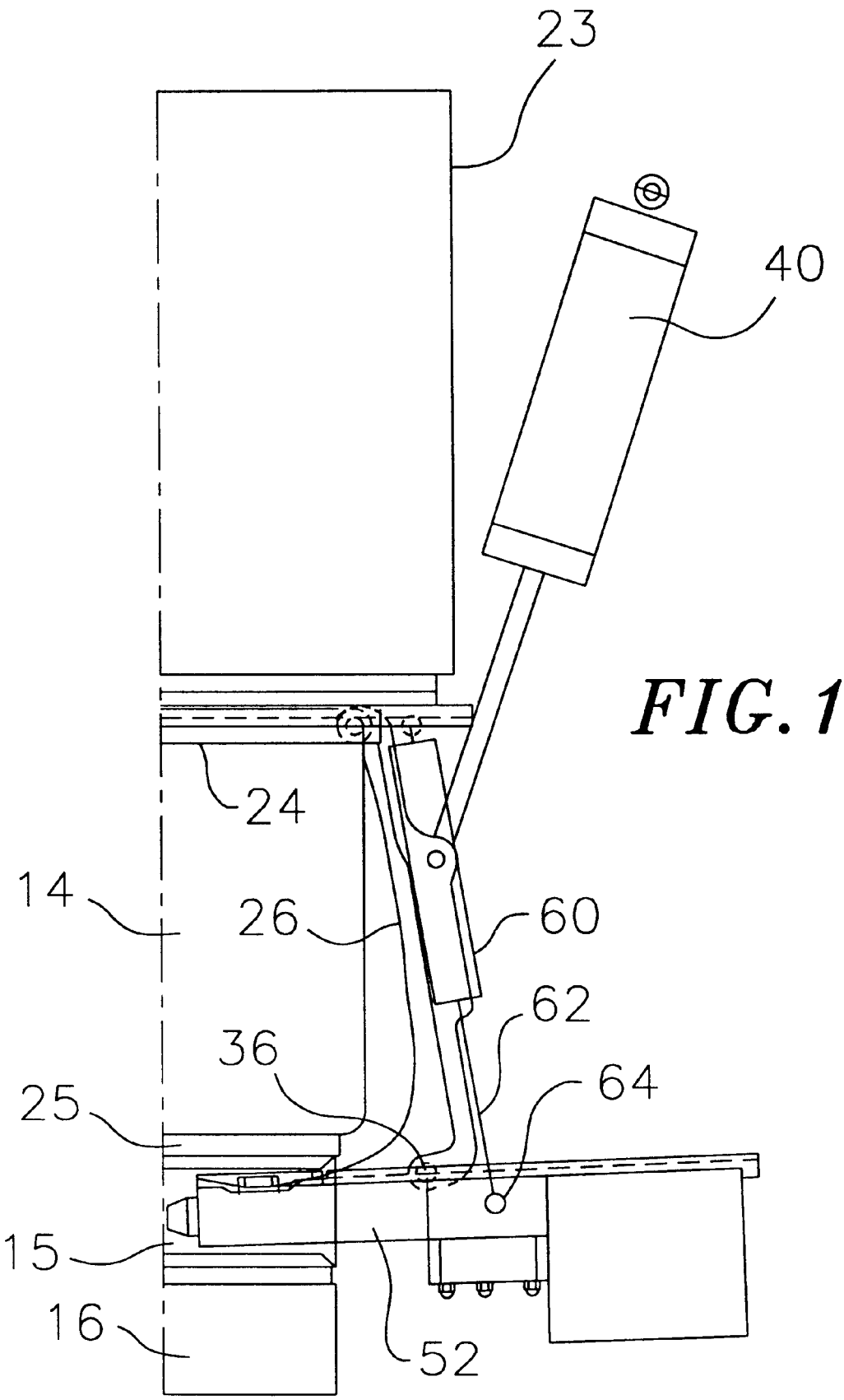
FIG. 10*c* is a semi-schematic cross-sectional view of a level arm positioning system at a third stage in the insertion process, illustrating the horizontal (level) orientation of a weld arm finger after insertion into the follow block.

With reference now to the exemplary embodiment of FIG. 10*c*, the finger assembly 52 has now been substantially completely inserted into its respective closure (or weld) cavity in the follow block 15 and is ready to engage the corresponding tip of the opposite finger assembly in order that the opposing strap ends might be juxtaposed for welding. In this particular instance, it is desirable that each of the respective finger assemblies be maintained in a horizontal position throughout the final few inches of travel such that their respective strap ends are disposed in substantially the same horizontal plane upon finger contact. Since each of the finger assemblies are pivoted into position by their respective pivot arms (54 and 56 of FIG. 8) the finger assemblies would necessarily travel along an arcuate path and only be disposed in the same horizontal plane at one tangential instant, unless some means were provided to maintain the finger assemblies in the same horizontal plane. Lever arm assembly 60 provides such a function by counter rotating each finger assembly 50 and 52 about its respective arm pivot points 34 and 36 in controlled fashion. It should also be noted that the lever arm assembly provides means for initially pivoting each of the finger assemblies in a downwardly direction about their respective arm pivot points 34 and 36 after the strap loading operation has been completed. The hydraulic cylinders (38 and 40 of FIG. 7) operate to rotate the entire assemblies from their fully raised to fully lowered positions by acting upon each assembly's pivot arm 54 and 56. In summary, the hydraulic cylinders 38 and 40 control the rotational aspect of each assembly, while the level arm assembly 60 controls the rotational aspect of each of the respective finger assemblies.

When both of the finger assemblies have been horizontally disposed within their respective closure cavities of the follow block 15, the opposing ends of the strapping material are juxtaposed (lapped) over one another are now in position for welding. Because the fingers are oriented in a substantially horizontal plane, the opposing strap ends are guided into proper position for welding and held in place, against vertical or lateral movement, once the opposing ends have overlapped one another. The horizontal orientation of the finger assemblies allows the strapping material to be biased into proper position without the torquing or other misalignment problems typically associated with convention chute-guided, post-pressing strapping systems.

A further advantageous feature of the present invention, and as will be particularly described below, is that the parallel orientation of the strapping material and the respective finger assemblies allows for a friction joint weld to be made in a direction along the length of the strap, as opposed to conventional systems in which a friction joint weld is made in a direction lateral to the strap, i.e., across its width. Making a parallel joint, as opposed to a perpendicular joint, ensures a more uniform joint area and a more uniform joint integrity, when compared to conventional thermoplastic strap offset joints.

Further, it has been found that a parallel joint formed according to the present invention has an enhanced tensile strength as compared to lateral joints formed according to contemporary practice. It is believed that longitudinal fibers formed during the parallel joint forming process contribute to the enhanced tensile strength of the joint.

As used herein, the term longitudinal is defined as that direction which is along the length of a strap and lateral is defined as that direction which is across the width of a strap (and is thus perpendicular to the longitudinal direction).

In addition to forming the joint in a parallel or longitudinal fashion, at least two additional factors provide further enhancement to the tensile strength thereof. First, the joint or weld is formed by simultaneously rubbing the two ends of the strap together and rocking the strap where the welding operation is taking place. Both the rubbing together and the rocking are performed in a manner which creates frictional heating that melts a portion of the thermoplastic material at the interface of the two strap portions. When this melted portion of the two strap portions solidifies, the two strap portions are welded together.

The two strap portions are rubbed together in a back and forth motion in the longitudinal direction of the two strap portions, as described above. This longitudinal motion is effected by gripping the two strap portions intermediate two welding plates. The two welding plates move back and forth, thus effecting a similar motion of the two strap portions so as to effect frictional heating thereof. According to the present invention, the two welding plates simultaneously rock as they move back and forth, so as to provide additional heating of the two strap portions, particularly, proximate the ends thereof, so as to provide enhanced tensile strength and improve peel resistance.

As used herein, rocking of the two weld plates is defined to include any non-translational movement thereof. Thus, rocking of the two weld plates includes rotation thereof, particularly about a pivot point located proximate a center of the length of the two plates, as discussed in detail below. Those skilled in the art will appreciate that rocking of the two weld plates may also be accomplished by facilitating rotation of the weld plates about other desired pivots, including those which are located at a distance from the pivot plates (such as beyond the two ends thereof).

As those skilled in the art will appreciate, such rocking of the weld plates causes the strap portions extending therefrom to flex, thus increasing the heat generated at the portions of the strap where the strap exits the weld plates. Each strap portion exits the weld plates near where the other strap ends. That is, a given strap will tend to flex and be heated at a point along its own length near to where the other strap portion ends, such that an enhanced weld is formed proximate each end of each strap portion. This enhanced weld proximate the end portion of each strap substantially enhances peel resistance.

Peel resistance is a resistance of the weld to having a strap end portion peeled away therefrom. Peeling of a strap portion away from the weld occurs when an end of a strap is pulled generally perpendicularly away from the strap in a manner which tends to separate the two strap portions. Once a peel has been initiated, failure of the weld may occur with substantially less force than the original (before peeling) tensile strength of the weld. Therefor, it is highly desirable to enhance the peel resistance of such a weld.

Undesirable peeling of a weld may occur when an end of a welded strap inadvertently catches on an object such that it is pulled generally perpendicularly away from the strap. This may occur during handling of a bale, such as when an end of a strap undesirably catches upon handling equipment. Such peeling of the end of a strap may then result in undesirable failure of the weld and consequently result in failure of the strap to contain at least a portion of the bale. When one strap has failed to contain a portion of the bale, the tension applied to the remaining straps of the bale increases proportionally, thereby increasing the likelihood of failure of the remaining straps. Thus, the failure of a single strap due to peeling of the strap end at the weld may result in the undesirable destruction of the entire bale. As such, the enhanced peel resistance provided by the present invention is a highly desirable feature thereof.

Further, rocking of the weld plates according to the present invention not only enhances peel resistance, but also further increases the tensile strength of the weld, by increasing weld penetration proximate the ends of the strap.

The tensile strength of the weld is yet further enhanced by using weld plates having an alternating pattern of teeth formed thereon, wherein the alternating pattern is configured so as to further enhance relative motion of the two strap end portions as the two strap end portions are welded together. The alternating pattern of teeth on each weld plate is configured such that some portions of the weld plate, along the length thereof, tend to grip the strap end portion very well while other portions of the weld plate, along the length thereof, tend not to grip the strap end portion as well and thus allow some movement of the strap relative to the weld plate. As such, some portions of the strap end portion tend to be held fixed relative to the weld plate, while other portions of the strap tend to move relative to the weld plate. In this manner, the complexity of the motion of each strap end portion relative to the other strap end portion is increased, thereby resulting in greater frictional heating, particularly in areas of the strap where the relative motion between strap portions is greatest. In such areas, weld penetration is improved, thereby contributing substantially to enhanced tensile strength of the weld.

Loading of the strapping material 26 into a weld arm finger assembly 52 in operation of the automatic bale strapping system for automatically wrapping straps around a compressed bale and welding the strap ends together, can be best understood by referring particularly to FIGS. 11–16.

Figure 11:
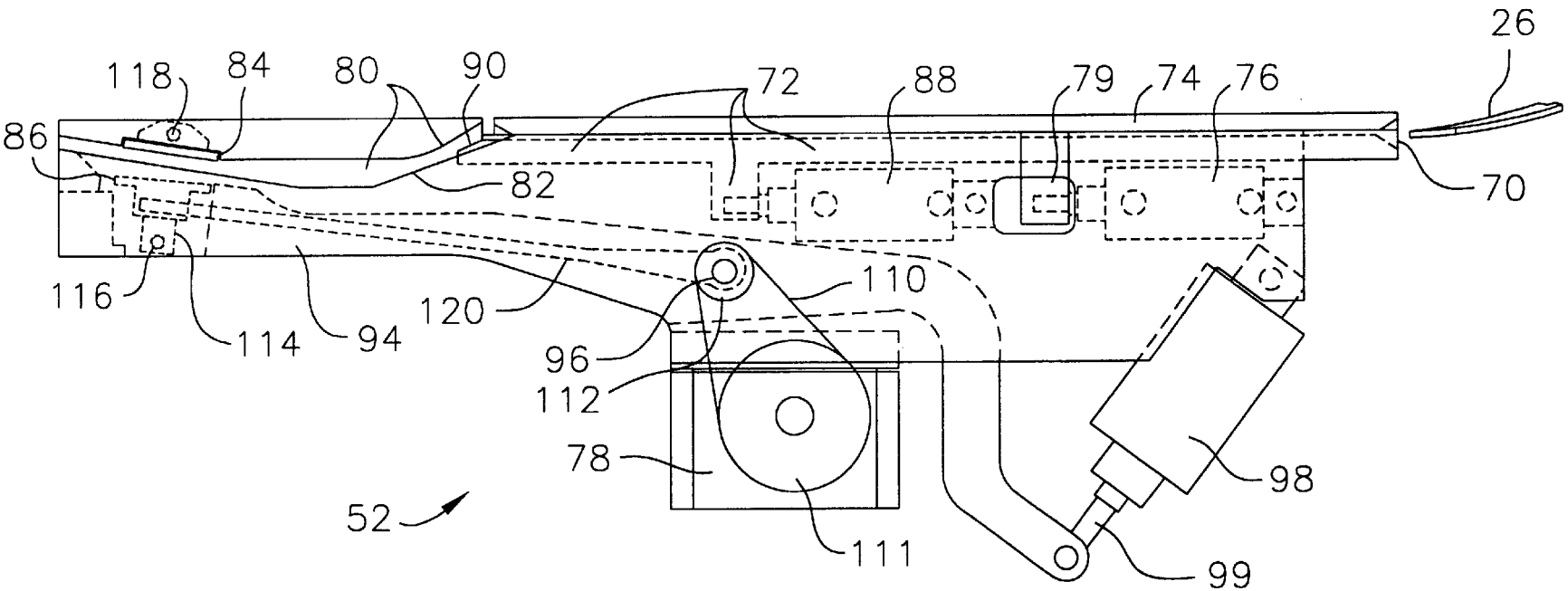
FIG. 11 is a semi-schematic side view of a weld arm finger assembly detailing its internal construction and operation during a strap insertion portion of a bale strapping operation.

Referring first to FIG. 11, there is shown a semi-schematic, simplified side view of a weld arm finger assembly 52, detailing the internal components of the finger assembly as strapping material 26 is inserted therein at the beginning of a tying operation. In particular, strapping material 26 is inserted into a chute 70 which is constructed as a wide, shallow, flat-bottomed u-shaped section, with a width and height dimension sufficient to retain a piece of strapping material without unduly binding or pinching the material during operation. The chute 70 has solid sides which comprise the body material of the weld arm assembly 52 and a longitudinally movable floor 72 which further functions as a lock mechanism, in a manner to be described in greater detail below.

A laterally sliding door member 74 is provided as the top surface of the chute and is maintained in position over the top of the chute during the strap loading operation and during the subsequent arm assembly and finger assembly pivoting operations, in order to retain the strapping material within the chute. As will be described in more detail further, the door 74 slides laterally, across the top surface of the finger assembly in order to expose the chute below and allow the contained strapping material to float free from the chute, and thus out of the finger assembly, after the welding operation has been concluded and the bale is ready to be expelled from the press. The door 74 might be a single piece of material which is slid laterally to expose the chute below, or alternatively might be two pieces of material that are slid away from one another to thereby expose the chute interior. Accordingly, the door mechanism 74 might be characterized as a set of doors that move horizontally across the top of a finger assembly in order to contain or release the enclosed strapping material from a chute having solid sides and movable floor that also functions as a lock. The door mechanism 74 is actuated by a door hydraulic cylinder 76.

It should also be worthwhile to note, at this stage, that each of the finger assemblies (50 and 52 of FIG. 8) is mounted on a main beam 79 which extends in the direction of the length of the bale (14 of FIG. 4) and ties all of the finger assemblies on each respective side of the bale together. As many finger assemblies as is required to tie a sufficient number of straps around a bale may be mounted upon the main beam 79, so long as sufficient closure cavities are provided in the press follow block to accommodate finger insertion and the strap welding operation. The main beam 79 rigidly supports each of the finger assemblies such that all of the plurality of finger assemblies disposed on one side or the other of the press move in unison during the pivoting, insertion and welding operations.

Figure 12:
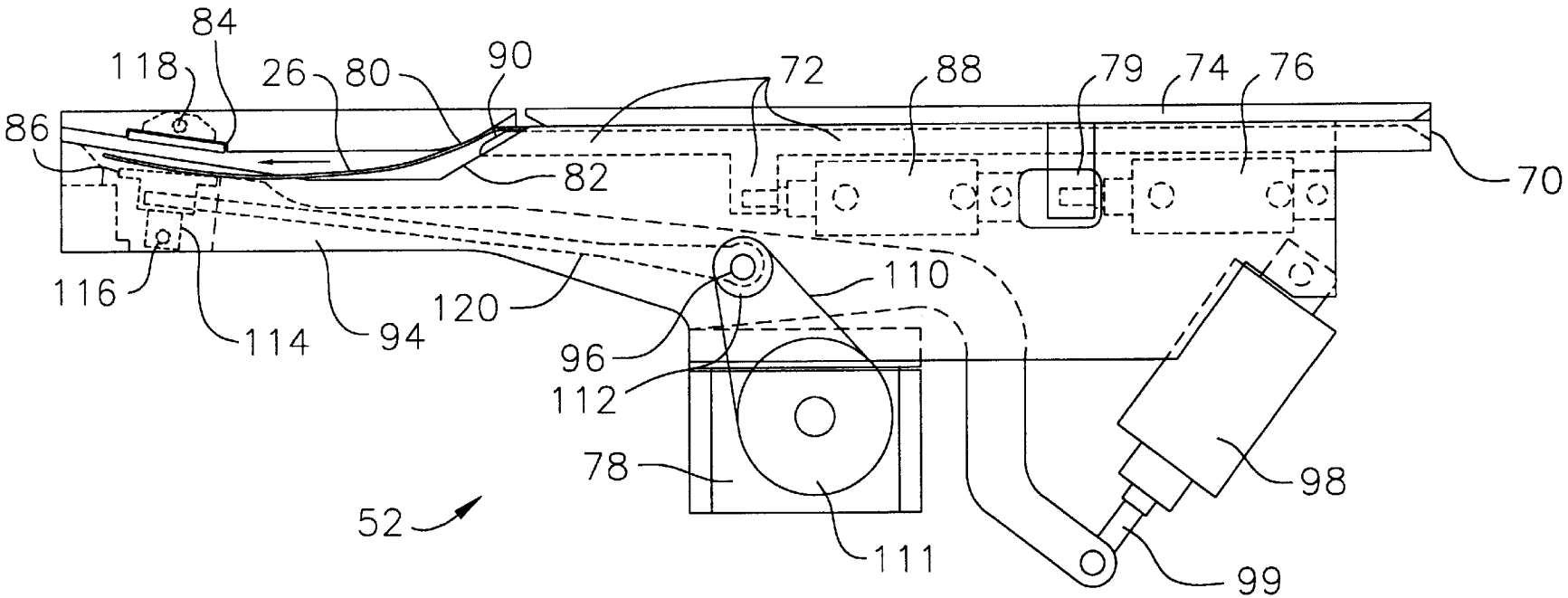
FIG. 12 is a semi-schematic side view of a weld arm finger assembly at a second stage in the strap insertion process.

Turning now to FIG. 12, the semi-schematic, side view of the weld arm finger assembly 52 illustrates the positioning of the internal components once strapping material 26 has been inserted through the chute 70 and has been fully fed into the weld arm finger assembly. As shown in the exemplary embodiment of FIG. 12, the front portion of the strapping material 26 has been extruded through the chute 70 and into a generally curved track comprising the front, or weld, portion of the weld arm finger assembly 52. As the strap material 26 enters the curved portion, it first traverses through a chicane section 80 which causes the strap material 26 to be forced downwardly towards the weld portion's floor 82, which in turn, guides the strap material 26 into position between a pivoting top welding plate 84 and a movably disposed bottom welding plate 86. Strap material 26 rests upon a welding pad forming the top surface of bottom welding plate 86 and is pressed into place upon the welding pad by pressure exerted by its traverse of the chicane 80. The strap material 26 is thus in a bowed and stressed condition imparted by the non-linear geometry of the front, weld portion, channel of the weld arm finger assembly 52.

Figure 13:
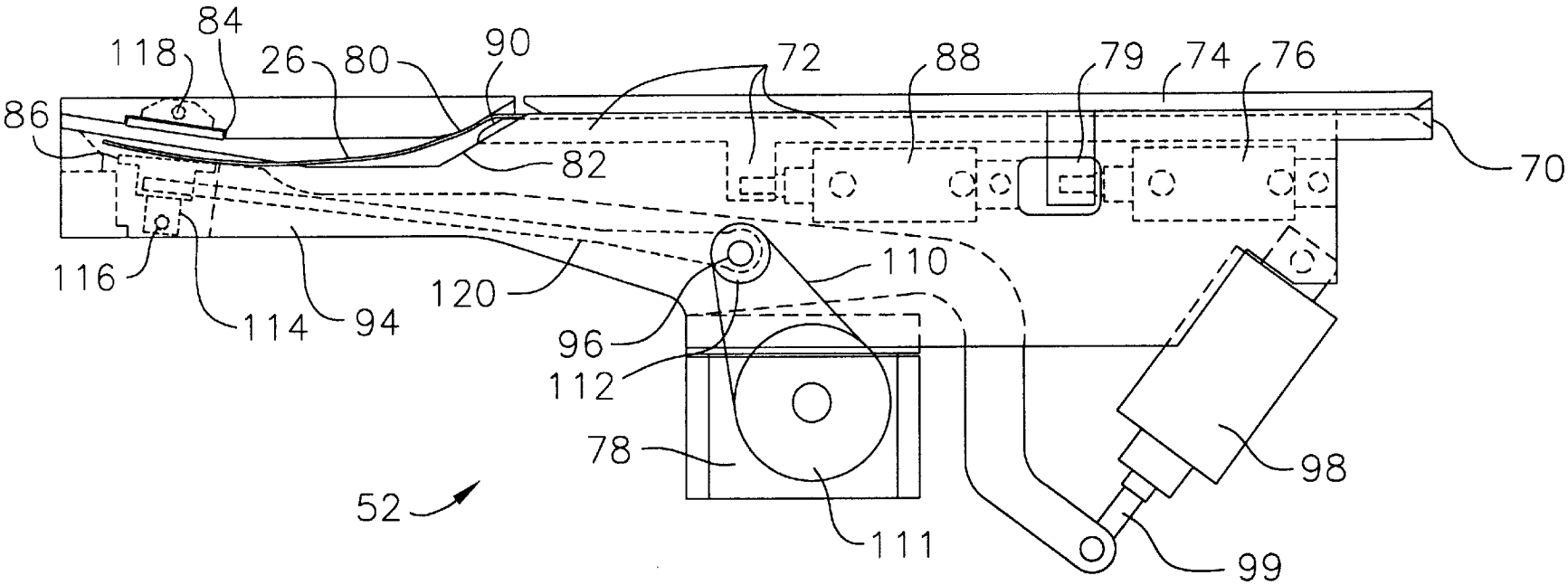
FIG. 13 is a semi-schematic side view of a weld arm finger assembly detailing the locking mechanism and bow-forming chicane.

Turning now to FIG. 13, once the strap material 26 has traversed the chicane 80 and has its distal end disposed over the surface of the bottom welding plate 86, the floor 72 of the chute 70 is caused to translate in a forward direction by a hydraulic "lock" cylinder 88. As the floor 72 section of the chute 70 travels forward, its distal end 90 is forced toward the chicane 80 until the strapping material 26 is forcibly pinched between the chute floor 72 and the chicane surface 80. The strapping material 26 is thus held in position against translational movement, back and forth in either the chute 70 or the weld portion channel. It should further be understood that action of the "lock floor" 72 in pinning strapping material 26 against the chicane surface 80, increases the bow pressure on the strapping material 26 such that the tip of the strapping material presses more securely upon the weld surface of the bottom welding plate 86.

Figure 14:
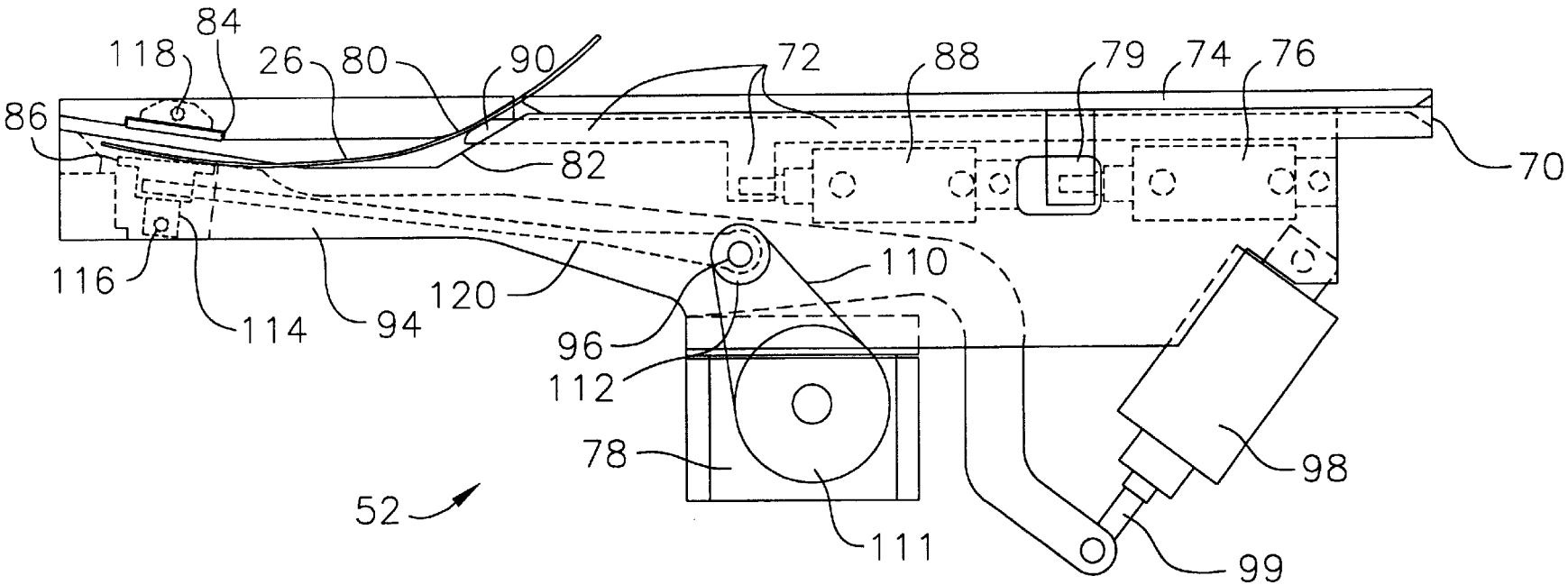
FIG. 14 is a semi-schematic side view of a weld arm finger assembly at the strap release stage of the process.

With regard to FIG. 14, the weld arm finger assembly 52 is illustrated in a semi-schematic side view, after the strap loading operation is complete and when the finger assemblies have been pivoted into their tie positions as illustrated in the exemplary embodiment of FIG. 7. As can be seen from FIG. 14, the strapping material 26 has been released from the loading chute 70 and is retained within the finger assembly 52 solely by the lock 72 pinching the strapping material 26 against the chicane surface 80. At this particular point, the door assembly 74 has been displaced by action of the hydraulic door cylinder 76 in order that the interior of the chute 70 be uncovered, thus allowing the strapping material 26 to float free from the chute and be wrapped around a compressed bale without further constraint. The lock assembly 72 prevents the strapping material 26 from being pulled out of the weld portion of the weld arm finger assembly or from being pulled back off the vibrator pad surface of the lower weld pad 86. The lock 72 further prevents reduction of the bow tension induced in the strapping material 26 by the chicane surface 80 of the weld portion of the weld arm finger assembly 52.

Figure 15:
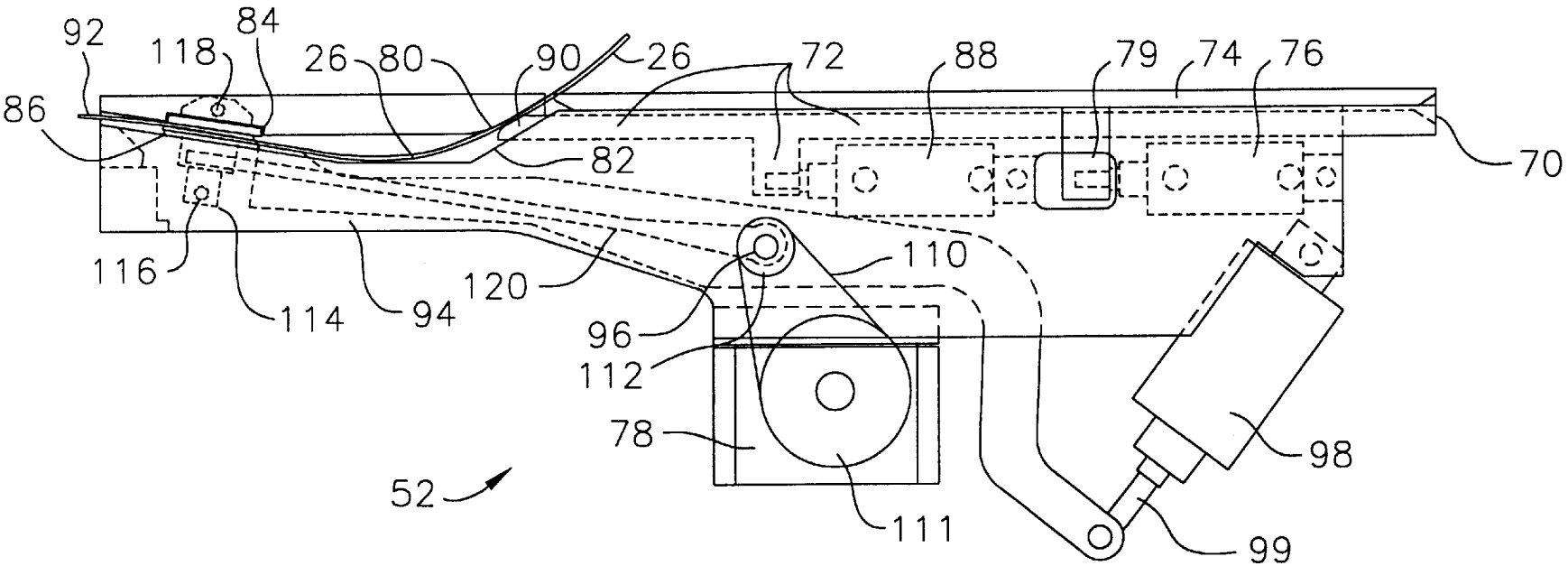
FIG. 15 is a semi-schematic side view of a weld arm finger assembly during the weld portion of the process.

Turning now to FIG. 15, the weld arm finger assembly 52 is depicted in semi-schematic, side view at a point in the operation after both finger assemblies have entered their respective closure cavities in the follow block and after the opposing strap tip has been delivered from the strapper tip support sled (32 of FIG. 6) into the weld arm finger assembly and fed over the end of the corresponding strapping material 26 contained within the weld arm finger assembly 52. The strapping material 26 and the opposing strap end 92 overlap one another in the region between upper and lower weld plates, 84 and 86 respectively, which have closed over the overlapping strap portions in order to provide a weld joint.

In this regard, the lower weld plate 86 is slideably coupled to a pivot arm assembly 94 which pivots about an eccentric pivot 96. The end of the pivot arm 94 opposite the lower weld plate 86 is coupled to, and actuated by, an actuator hydraulic cylinder 98. When the cylinder 98 is actuated, a linkage arm 99 pushes on the lever arm 94, causing it to rotate about pivot 96, thereby forcing the other end, coupled to the lower weld plate 86, into proximity with the upper weld plate 84. Thus, the upper weld plate 84 is held generally stationary and the lower weld plate 86 moves upwardly theretoward. As an alternative, the present invention may be configured such that the lower weld plate 86 is held generally stationary while the upper weld plate 84 moves downwardly theretoward. The strapping material 26 and its opposite end 92 are thereby pinched between the upper and lower weld plates and are in condition for welding. The pivot arm assembly 94 pivots about a concentric portion of eccentric pivot pin 96, such that rotation of the eccentric pivot pin 96 does not effect substantial movement of the pivot arm 94. Rather, the eccentric portion of eccentric pivot 96 is used to effect reciprocating movement of the connecting rod 120 (and consequently the lower weld plate 86 as well), as described in detail below.

A friction welded joint is formed in the interface region between the two overlapping ends of the strapping material (26 and 92) by gripping one side of the interface with the upper weld plate 84, while the lower weld plate 86 vibrates, at high frequency, to impart friction heating to the interface region. Alternatively, the upper weld plate 84 may be vibrated, while the lower weld plate 86 is held generally stationary. As a further alternative, both the upper 84 and lower 86 weld plates may be vibrated, preferably in generally opposite directions with respect to one another. Friction heating causes the thermoplastic material in the interface region to change its state into a partially liquified form, which then interpenetrates and, when allowed to cool, and solidify, forms a resulting weld joint.

Welding motion is accomplished by coupling the connecting rod 120 to eccentric pivot pin 96, which is rotated at a high speed, by a motor 78 coupled to the eccentric pivot pin (eccentric crank) 96 by a belt 110 and pulley 111, 112 arrangement. When the eccentric crank is rotated, the connecting rod 120 is necessarily displaced back and forth at a vibrational speed proportional to the rotational speed of the drive motor. At the same time, hydraulic cylinder 98 supplies a controlled tension to the lever arm 94 which causes the lower weld plate 86 to apply pressure (via support block 114) to the strap interface area while the lever arm causes the lower weld plate 86 to vibrate, imparting sufficient heat to the interface to melt the interface region of the overlapping strap portions.

Thus, the lower lever arm 94 applies upward pressure to the lower weld plate 86 through the support block 114, upon which the lower weld plate 86 slides. The lower weld plate 86 slides along the top surface of the support block 114 as the lower weld plate 86 reciprocates due to movement of the connecting rod 120 caused by the eccentric pivot pin 96. The support block 114 is pivotally mounted to the lever arm 94 via pivot pin 116, so as to facilitate rocking of the upper and lower 86 weld plates, as discussed in detail below.

The support block 114 optionally comprises a low-resistance upper surface which contacts the lower portion of the lower weld plate 86, so as to minimize wear. For example, the support block 114 may have an upper surface formed of TEFLON or DELRIN.

As mentioned above, the cylinder 98 (which may be either air or hydraulically operated, as desired) urges the lower weld plate 86 toward the upper weld plate 84. As the pivot arm 94 is moved upwardly toward the upper weld plate 84, the support block 114 pushes the lower surface of the lower weld plate 86 upwardly. The support block 114 pivots about the lower pivot pin 116 so as to accommodate angular or rocking motion of the lower weld plate 86 as the lower weld plate 86 reciprocates longitudinally in response to rotation of the eccentric crank 96.

As those skilled in the art will appreciate, as the eccentric pivot pin 96 rotates, the proximal end of the connecting arm 120 attached to the eccentric pivot pin 96 inherently moves up and down. This up and down motion of the proximal end of the connecting rod 120 effects rocking of the lower weld plate 86 which causes the support block 114 to pivot about the lower pivot pin 116.

Rocking of the lower weld plate 86 causes similar rocking of the upper weld plate 84, thereby causing the upper weld late 84 to pivot about the upper pivot pin 118. In this manner, the upper weld plate 84 and the lower weld plate 86 tend to rock generally in unison. This rocking of the upper and lower weld plates flexes or exercises the upper and lower pieces of the strap, particularly where the upper and lower pieces of the strap exit the upper and lower weld plates, thus further heating the upper and lower pieces of strap so as to enhance thermal bonding therebetween.

The motor 78 is preferably operated for approximately two seconds. The pulleys 111 and 112 are preferably configured so as to result in rotation of the eccentric pivot pin 96 at between approximately ten thousand and twenty thousand RPM when the motor 78 is operated. A five-to-one ratio of the pulleys is suitable. Those skilled in the art will appreciate that various other rotational speeds of the eccentric pivot pin 96, including speeds in excess of twenty thousand RPM, are likewise suitable.

The connecting rod 120 is preferably formed so as to have a center-to-center length of approximately ten inches. The crank radius of the eccentric pivot pin 96 is preferably approximately 0.050 inch. Thus, the total longitudinal travel of the weld plates is approximately 0.100 inch. The length of each weld plate 84 and 86 is preferably approximately 3 inches. Thus, movement of each end of the weld plates in the vertical direction is approximately 0.0075 inch up and 0.0070 inch down for a total vertical movement of approximately 0.015 inch as the eccentric pivot pin 96 is rotated. The force applied to the two strap end portions by the upper and lower weld plates, 84 and 86, is preferably between approximately two hundred pounds and approximately three hundred pounds. The pressure applied to the two strap end portions by the upper and lower weld plates is preferably approximately three hundred pounds.

The motor 78, pulleys 111 and 112, eccentric pivot pin 96 and connecting rod 120 cooperate to define a drive which effects both longitudinal movement and rocking of the lower weld plate 86.

In certain applications, and when using certain types of thermoplastic strapping material, it might be desirable to release the pressure on the interfacing strap regions as soon as suitable thickness of each strap portion has melted together in the interface region. Necessarily, if pressure is released when the weld joint is still molten, the weld joint must be isolated from any tension or stress to which other parts of the strap may be subjected. In the majority of applications, pressure is maintained on the interface region for a sufficient period of time in order to permit the molten joint portions to cool and at least partially solidify under pressure.

Optionally, side skirts (not shown) may be provided so as to extend along substantially the entire length of the weld plates 84 and 86 in a manner which substantially inhibits escape of plastic hairs which tend to be produced during the welding process. Such side skirts are particularly beneficial in those instances wherein contamination of the material being baled with such plastic hairs is undesirable.

It should further be noted that the bow portion of strapping material 26 disposed within the chicane 80 is particularly advantageous in promoting high speed friction welding without introducing the danger of tensional stress displacing the strap portion 26 off of the lower weld pad 86. As the weld pad 86 vibrates, it moves a small distance along the extended length of the strapping material. The bow alternately straightens and curls, in response to vibratory motion of the lower weld plate 86, to allow for the motion of the weld plate. The lock 72 remains in place, in order to prevent the strapping material being pulled around the bale from interfering with the welding process. Isolating the weld portion of each strap from that other portion of the strapping material being pulled around the bale, allows for an extremely well controlled welding process because of the relatively complete elimination of elongation stresses in the joint portions of the strap. In addition, the upper weld pad 84 is mounted and floats upon a pin 118 in order to allow for certain small discrepancies in strap thickness and finger assembly tip-to-tip alignment.

In order to further control the welding process, the hydraulic cylinder 98 might be configured to act upon lever arm 94 through a controlled spring, as opposed to a link arm 99. A controlled spring might be constructed with a particular force constant k which would exert a more exact force upon its corresponding end of the lever arm 94 and, thereby translate a more precise pressure upon the interface joint areas of the strap. Additionally, a controlled spring would allow for the spring to be adjusted for specific strap material types and thicknesses, and the hydraulic cylinder 98 could be smaller and consequently less expensive because it would not be required to hold or exert a critical tension.

It is yet further believed that inertia causes the upper weld plate 84 to lag somewhat in its rocking motion with respect to the lower weld plate 86. This lag tends to exaggerate the compressive forces experienced by the upper and lower strap portions, 92 and 26, particularly proximate the ends of the upper and lower weld plates. That is, this lag in motion of the upper weld plate tends to cause the upper and lower weld plates to cooperate so as to pinch the strap near the end portions thereof. Thus, such lagging will cause the pressure to vary both temporally and spatially along the length of the weld plates. As those skilled in the art will appreciate, regions of the weld which experience higher pressures generally tend to have greater weld depth penetration and therefore contribute disproportionally and substantially to the strength of the weld.

Figure 16:
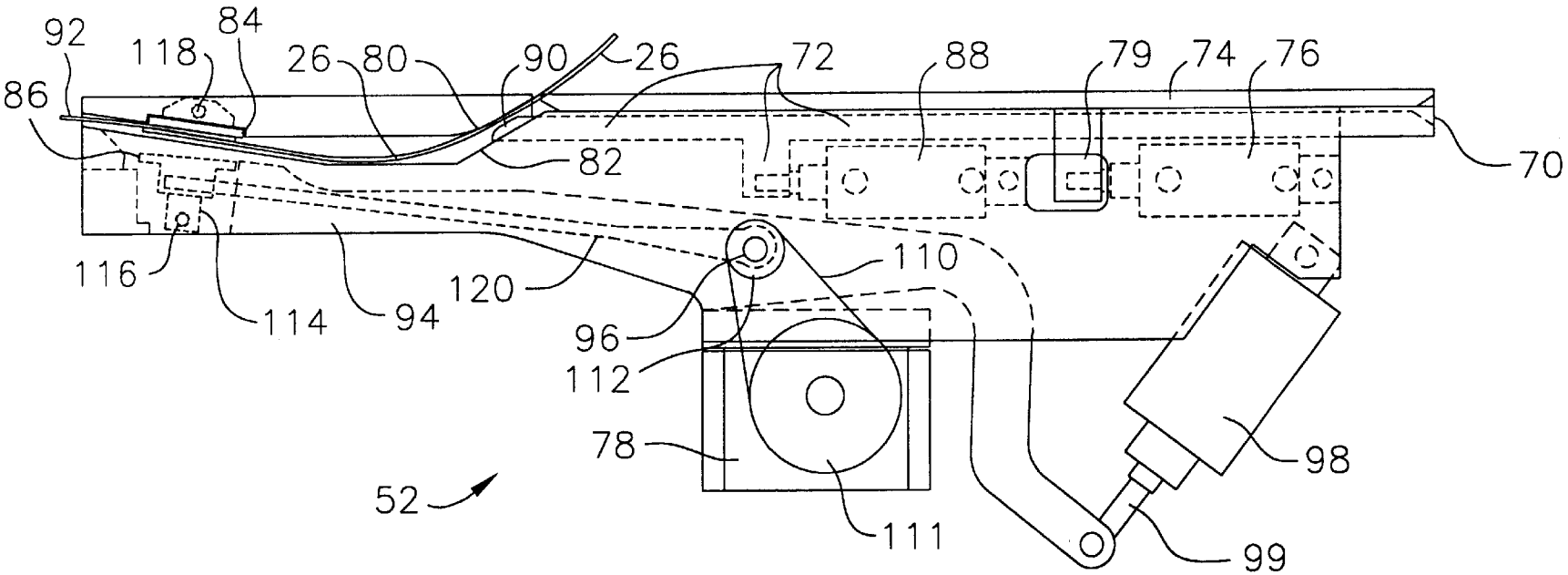
FIG. 16 is a semi-schematic side view of a weld arm finger assembly after weld formation has been completed and the lock retracted, thereby releasing the strap and thus the bale for ejection from the press.

With regard now to FIG. 16, the weld arm finger assembly 52 is depicted in semi-schematic form at that point in the operation where the weld is substantially complete and the automatic bale tying system is ready to be moved from its tying position back to the loading position as depicted in the exemplary embodiments of FIGS. 4 and 5. As seen in FIG. 16, the lock cylinder 88 has withdrawn the lock assembly 72 from its position proximate to the chicane surface 80, thereby releasing the strapping material 26. The strap has been welded and cooled, and hydraulic cylinder 98 has retracted the lower welding pad 86, such that the strap is now free to be released from the weld arm finger assembly and the tied bale is ready to be expelled from the press. The system displaces the finger assemblies sideways, releasing the strap from the weld channel, extracts the finger assemblies from the follow block closure cavities and repivots the arm and finger assemblies to the loading position in preparation for tying a next bale.

It will be appreciated that the weld joint in accordance with the present invention is made by imparting a vibratory motion to the interface region of the overlapping strap ends in a longitudinal direction with respect to the straps, as opposed to laterally. Accordingly, joint formation is accommodated over a relatively uniform overlapping interface area over substantially all of the interface. Longitudinal weld formation offers superior joint placement in contrast to lateral weld motion, since in lateral weld motion the edges of the straps are not in continuous registry with one another causing joint formation at the edges to be rather poor. This introduces a particular source of weakness in the overall joint since the joint is formed only in the central portion of the overlapping straps. Joints formed in accordance with the system and method of the present invention are relatively uniform across the entire width of a strap, giving a substantially stronger joint.

Figure 17:
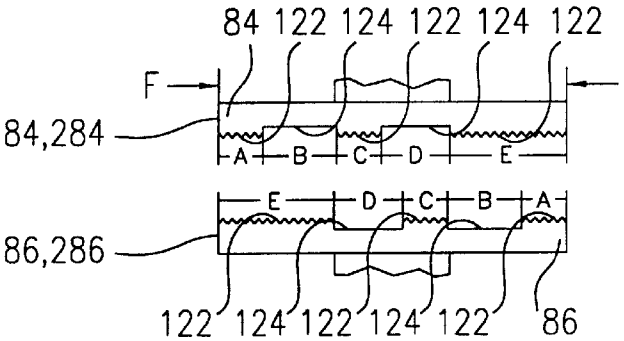
FIG. 17 is a semi-schematic side view of the first and second weld plates, showing the alternating pattern of teeth and flat portions formed thereon.

Turning now to FIG. 17, both the upper and lower weld plates 84 and 86 have articulations or teeth 122 which are used to retain the strapping material in position with respect to the weld plates. These teeth 122 are cut in the faces presented to the strapping material in order to prevent the strapping material from displacing with respect to the welding plates.

The teeth 122 cut in the upper welding plate 84 prevent the upper piece of strap 92 from displacing when welding is occurring. Similarly, teeth cut in the surface of the lower welding plate 86 prevent the lower strap 26 from slipping along the face when the welding plate 86 is moved at a high frequency during welding. The teeth 122 are preferably formed upon generally planar lands which may be defined by grooves 124 formed into the upper and lower weld plates 84 and 86. The resulting alternating pattern of teeth 122 and grooves 124 is formed so as to cause the upper piece of strap 92 and the lower piece of strap 26 to bend or buckle slightly intermediate the upper and lower weld plates 84 and 86 as the lower weld plate 86 moves longitudinally with respect to the upper weld plate 84. That is, the teeth 122 are arranged upon the upper and lower weld plates 84 and 86 so as to tend to push the upper strap 92 and the lower strap 26 into the grooves 124 during the welding process. Such pushing of the upper piece of the strap 92 and the lower piece of the strap 26 into the grooves 124 exercises the upper piece of the strap 92 and the lower piece of the strap 26, so as to enhance heating thereof such that a bond formed therebetween has enhanced strength.

Preferably, the alternating pattern of teeth 122 and grooves 124 on the upper plate 84 is substantially a mirror image of the alternating pattern of teeth 122 and grooves 124 on the lower plate 86. More particularly, the upper plate 84 is preferably formed so as to have a first section of teeth 122 having a length of approximately ⅜ inch (dimension A), a first groove having a length of approximately ⅝ inch (dimension B), a second section of teeth having a length of approximately ⅜ inch (dimension C), a second groove having a length of approximately ⅝ inch (dimension D), and a third section of teeth having a length of approximately 1 inch (dimension E). Similarly, the lower weld plate 86 is preferably formed so as to have a first section of teeth 122 having a length of approximately ⅜ inch (dimension A), a first groove having a length of approximately ⅜ inch (dimension B), a second section of teeth 122 having a length of approximately ⅜ inch (dimension C), a second groove 124 having a length of approximately ⅝ inch (dimension D), and a third section of teeth 122 having a length of approximately 1 inch (dimension E).

The depth of each groove is preferably between approximately 0.010 inch and approximately ⅛ inch, preferably approximately 1/16 inch with respect to the tips of the teeth 122. Each weld plate, 84 and 86, preferably has a length of approximately three inches (dimension F). Those skilled in the art will appreciate that various other dimensions and patterns of teeth and grooves will similarly result in enhanced bending or flexing of the thermoplastic strap material (and consequently result in increased heating and enhanced bonding thereof).

Although the teeth 122 are described herein as having a generally square base and being generally shaped like a pyramid, those skilled in the art will appreciate the various other configurations of the teeth are likewise suitable. For example, the teeth may alternatively have a ramped or saw-tooth cross-section. Indeed, the teeth may have any configuration which facilitates gripping of the strap. Therefore, discussion of the teeth as being square-based pyramids is by way of illustration only, and not by way of limitation.

The alternating pattern of teeth may be formed by providing various different patterns of teeth and/or combinations of different types of teeth. Those skilled in the art will appreciate that various different longitudinal patterns of teeth are suitable for providing areas along the length of the weld plates which alternately grip and release the strap.

The alternating pattern of teeth may be formed by providing teeth having various degrees of sharpness. That is, some teeth may have pointed tips, while other teeth may have dull or flat tips. As those skilled in the art will appreciate, the pointed tips will tend to grab and hold the strap much more readily than the flat tips. The flat tips may be formed by first forming all of the teeth to have sharp tips and then grinding or otherwise removing the pointed tips of teeth in selected areas of the weld plates. Thus, varying degrees of sharpness of the teeth are provided.

The teeth preferably extend substantially to each edge of the weld plate. Alternatively, the weld plate may have a width which is substantially greater than the width of the teeth pattern formed thereupon.

The automatic bale strapping system in accordance with the present invention offers several advantageous features over conventional strapping systems as exemplified by the prior art. In particular, welds formed according to the present invention have enhanced tensile strength and peel resistance. Enhanced tensile strength is provided, in part, due to rocking of the weld plates as the weld is formed. Enhanced tensile strength is also provided, in part, due to slipping of portions of the weld strap within the weld plates caused by the alternating pattern of teeth formed thereon. Enhanced peel resistance is provided by the rocking motion of the weld plates.

Further, in particular, the system according to the invention is able to load strapping material into the apparatus and precut the strap to a specific length while the baling press is still moving to compress a bale. Straps are therefore prepositioned, to either side of the bale, to be wrapped around the bale and welded together as soon as the press ram reaches a predetermined travel limit. The system does not need to wait until the pressing operation is completed before initiating the bale tying process. Since each of the straps have been precut to a specified length, even tension is maintained on each of the straps once they have been securely welded together beneath the bale in a manner described above. Compressed bales are consequently more uniform in size and shape allowing for more efficient bagging, stacking and shipping and a consequent lowering of ginning costs. Further, extruding strapping material from a spool and precutting strapping material after it has been inserted in to the apparatus significantly reduces the waste associated with strap "tails" which are left as a residual appendage after conventional friction welding operations.

A further advantageous feature of the system according to the invention resides in the understanding that both ends of the strap material are protected within their respective finger assemblies, with no portion of the strapping material protruding outside the apparatus such that the tip could be bent or crimped form an inadvertent impact. In particular, the strapper tip support sled both protects its respective strap tip and positions the strap tip for engagement with its opposite number during the welding process. Since the sled is free to slide upon contact with the weld arm finger assembly, no complex equipment nor actuator sequences are required. Indeed, the sled might suitably be controlled by a simple spring disposed within the strapper assembly which extends the sled as the feeder assembly retracts, and allows the sled to retract upon contact force exerted by the weld arm assembly, thereby exposing its respective strap tip.

The baling press profile and system complexity is further minimized by the level arm positioning link system which orients the respective finger assemblies into a horizontal position during their insertion into closure cavities of the follow block. Since the finger assemblies are inserted in a substantially horizontal orientation (substantially parallel to the plane of the follow block) the follow block profile can be lowered in order that the closure cavities have sufficient room to admit the respective arm assemblies and no more. The leveling system further ensures that the weld and strapper finger assemblies are disposed in substantially the same horizontal plane, such that when the tips are in registry with one another the strap ends will overlay one another in the proper manner.

In this regard, the lock and chicane section of the weld arm finger assembly creates a bowed section in its respective strap end for controlled welding. The strap bow further forces the strap tip in a downwardly direction, thereby allowing the opposing strap tip to pass over its top surface without the danger of end-to-end abutment.

Generally, it is desirable that some slack be provided in each strap as the straps are welded together. Such slack readily facilitates the relative motion of the straps, which is necessary for the welding process. Slack may be provided by various different methods. For example, a cut length of strap may be provided so as to have a length which is slightly greater than the circumference of the compressed baled material. The two ends of the cut strap may be locked into position proximate the weld plates, so as to maintain the desired slack.

Alternatively, an arm or other member may be utilized to hold a portion of the strap away from the material being baled, so as to define and maintain the necessary slack during the welding operation.

Figure 18:
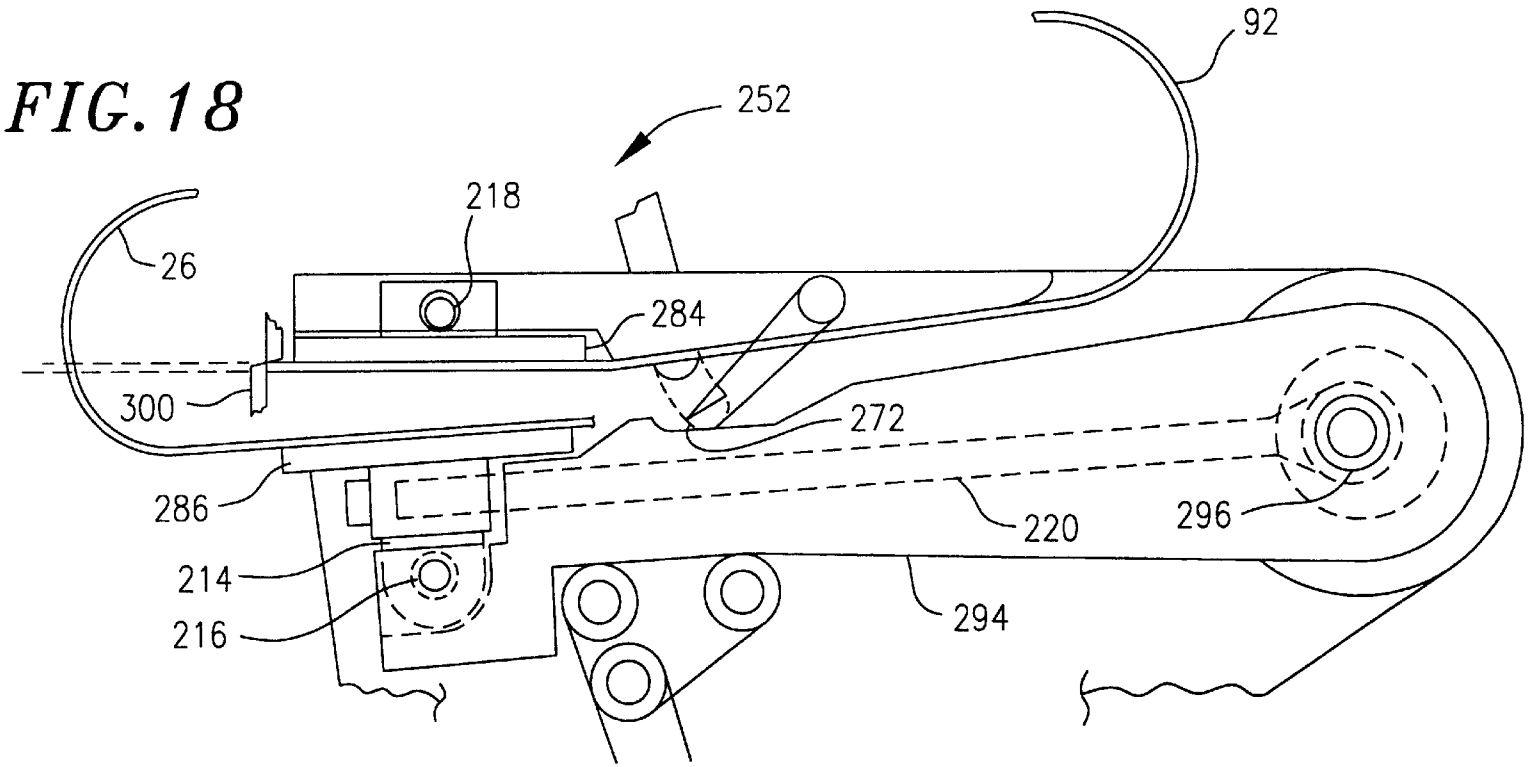
FIG. 18 is a semi-schematic side view of an alternative configuration of the weld arm finger assembly, showing the first and second weld plates separated from one another.
Figures 19, 20:
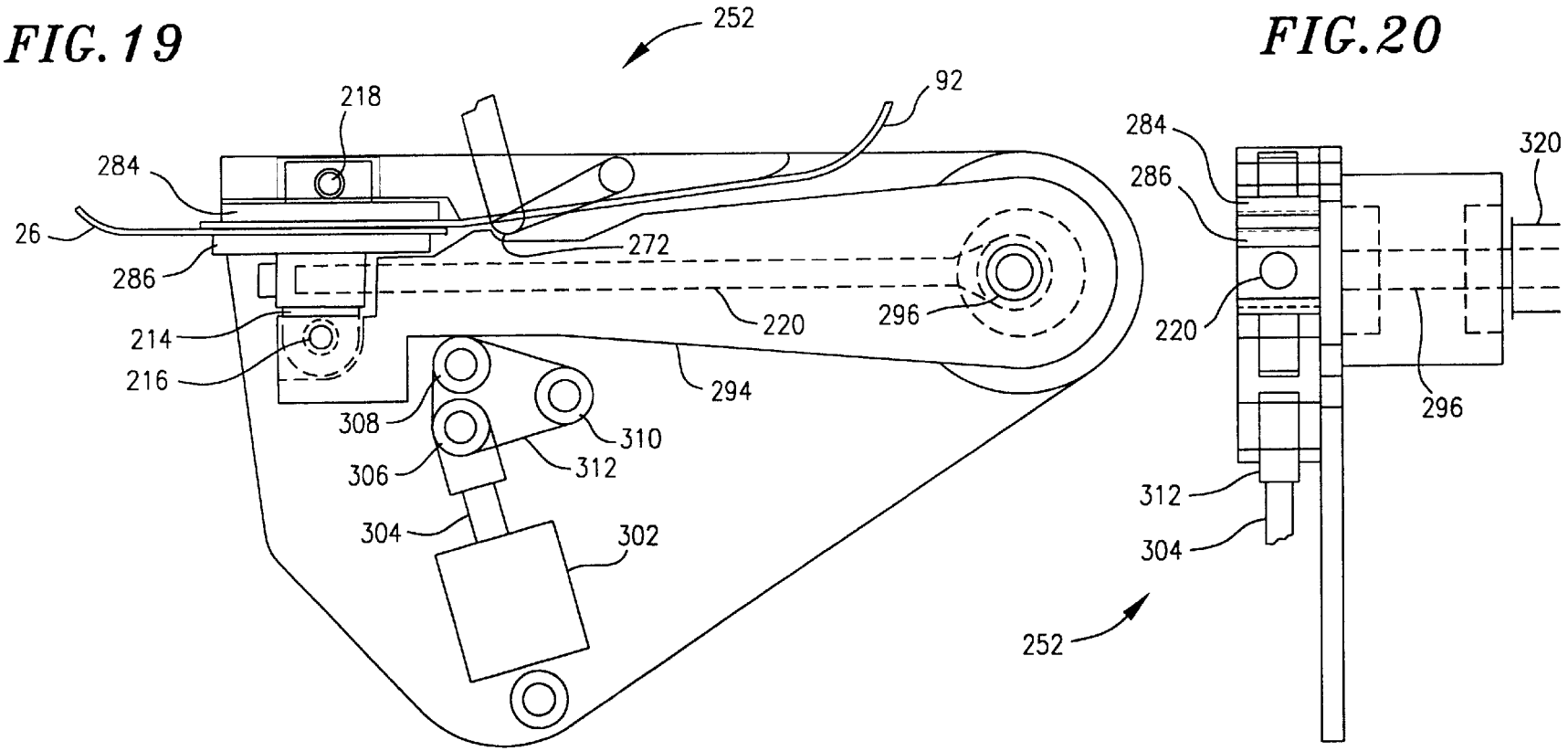
FIG. 19 is a semi-schematic side view of an alternative configuration of the weld arm finger assembly, of FIG. 18 showing the first and second weld plates moved toward each other.
FIG. 20 is an end view of the weld arm finger assembly of FIG. 18.

Turning now to FIGS. 18–20, an alternative configuration of the finger assembly 252 is shown. According to this alternative configuration of the finger assembly 252, the air cylinder 302 (FIG. 20) has been moved to the same side of the eccentric pivot 296 as the upper and lower weld plates 284 and 286. Thus, according to this alternative configuration of the present invention, the air cylinder 302 is located generally intermediate the eccentric pivot 296 and the weld plates 284 and 286, rather than being disposed on the opposite side of the eccentric pivot 296 from the weld plates 284 and 286 (as in the configuration shown in FIGS. 11–16). Also, according to this alternative configuration of the finger assembly 252, the strap may be fed through the upper and lower weld plates 284 and 286 prior to cutting the strap (as opposed to cutting the strap 26 before the strap is fed between the upper and lower weld plates 84 and 86 as described with respect to FIGS. 11–16 above). Further, the upper section of strap 92 is held in place via lock pin 272 which moves upwardly to capture the upper strap portion 92 and prevent longitudinal movement thereof during the welding process. Otherwise, the basic operation of this alternative configuration of the finger assembly 252 is similar to that of the finger assembly illustrated in FIGS. 11–16.

According to this alternative configuration of the present invention, the strap 26 may be fed into the finger assembly 252 from the left, be wrapped around the item being baled and then be brought back into the finger assembly 252, again from the left. The strap 26 is then cut with cutter 300 to form the two overlapping ends thereof which are to be welded to one another. The cutter 300 may be mechanically linked to the stop pin 272, such that when the lock pin 272 is actuated, the cutter 300 cuts the strap. Thus, according to this alternative configuration of the present invention the cutter 300 is preferably mechanically attached to the finger assembly 252. Alternatively, the strap 26 may be fed into the finger assembly 252 in any other desired manner and may similarly be cut in any other desired manner.

In operation, this alternative configuration of the finger assembly 252 functions similarly to the above-described configuration discussed in connection with FIGS. 11–16. More particularly, the actuator 302 urges the pivot arm 294 upwardly via linkage 312. Preferably, actuator arm 304 is connected to linkage 312 via pivot 306. Linkage 312 rotates about pivot 310. Roller 308 facilitates a low fiction abutment to the pivot arm 294, so as to reduce wear.

After the pivot arm 294 has been moved upwardly from its initial or open, strap receiving position as shown in FIG. 18 to its closed, vibrating position as shown in FIG. 19, a motor (not shown), which is coupled to eccentric pivot 296 via coupling 320, effects rotation of the eccentric pivot 296 so as to reciprocate connecting rod 220 which similarly reciprocates lower weld pad 286. Lower weld pad 286 is held against the lower strap portion 26 via support block 214 which rotates about pivot 216. Similarly, upper weld plate 284 rotates about pivot 218. Thus, as eccentric pivot pin 296 rotates, the lower weld plate 286 both reciprocates (moves back and forth longitudinally) and rocks, while the upper weld plate 284 rocks, but does not reciprocate. Thus, according to this alternative configuration of the present invention, the upper strap end portion 26 and the lower strap end portion 92 are caused to both rub back and forth longitudinally with respect to one another and are also caused to rock, as in the configuration of the present invention discussed in connection with FIGS. 11–16 above.

Optionally, the actuator 302, as well as any actuator utilized to effect movement of the lock pin 272 and/or cutting via cutters 300, may be located off of the finger assembly 252 and connected thereto, such as via mechanical linkage. In this manner, a slimmer, more compact design of the finger assembly 252 is facilitated, such that the finger assembly 252 may be utilized in applications requiring such a slimmer, more compact design.

As described above, longitudinal motion (along the length of the strap) of the upper and lower weld plates 84 and 86 in combination with the rocking of the upper and lower weld plates causes elongated longitudinal fibers to form within the weld in a manner which substantially enhances the tensile strength of the weld.

As described with the previous embodiment, rocking motion heats the strap in the area proximate the cut ends of the strap so as to effect enhanced welding proximate the cut ends of the strap. Such enhanced welding proximate the cut ends of the strap is particularly beneficial since one important aspect of strap weld strength involves resistance to peeling of one end portion of the strap away from the other strap. Once peeling of one strap away from the other strap has commenced, then continued peeling requires substantially less effort than was required to commence peeling.

Therefore, it is desirable to enhance the peel resistance of a strap. That is, it is desirable to enhance the weld strength proximate the cut ends of the strap so as to inhibit undesirable peeling of one strap away from the other strap. The rocking motion of the strap effected by the rocking movement of the upper and lower weld plates effects enhanced heating of both strap portions around the ends of the upper and lower weld plates such that weld penetrations proximate the cut ends of the strap is enhanced. Such enhanced heating of both mated strap portions proximate the cut ends thereof results in a stronger weld in this region and, consequently, in desirably enhanced peel resistance.

It is important to appreciate that the strap welding system and method of the present invention may be utilized to package or strap various different materials and items. For example, the present invention may be utilized to strap various synthetic and natural fiberous materials such as cotton, flax, fiberglass and glass wool. Further, the present invention may be utilized to strap various different items such as bricks, cinder blocks, lumber and stone. Indeed, the present invention may be utilized to package or strap various different materials and items.

It is worthwhile to note that the weld provided by the present invention is physically distinguishable from welds provided by contemporary devices. Not only is the weld stronger, i.e., has a higher tensile strength when compared with similar contemporary welds, but the weld also has visually distinguishable physical characteristics. For example, the end portions of a weld formed according to the present invention have deep penetrations which may be observed by forcibly peeling the ends of the weld apart. These deep penetrations are observed as comparatively deep gouges formed within the end of the band strap from the other band strap is peeled, and are thus somewhat indicative of the depth of the weld penetration at the ends of the straps. Further, the middle portion of each weld reveals a plurality of elongated threads which extend substantially from one end of the weld to the other and may be observed upon peeling the weld apart. Indeed, as the weld is peeled apart, a plurality of such threads generally pull away from the weld and extend visibly generally outwardly therefrom.

According to both configurations of the present invention, the eccentric pivot pin and the weld plates are preferably formed of O-1 tool steel, the connecting rod is preferably formed of either C4130 or C4340 steel and the remaining structures are formed of cold rolled C1018 steel. However, those skilled in the art will appreciate that various other materials are likewise suitable in the practice of the present invention.

It will be readily observed from the foregoing detailed description and exemplary embodiments of the present invention that numerous variations and modifications may be made without departing from the spirit and scope of the novel concepts or principles described. Because of the considerable variations which may be made by those skilled in the art to the arm assemblies, the finger assemblies, the weld grippers and the specific structure of the weld arm, the present invention is not intended to be limited to the embodiments described above but is intended to embrace all alternatives, variations and equivalents falling within the scope of the invention as defined by the following claims.

What is claimed is:

1. A method for welding the end portions of a thermoplastic baling strap together, the method comprising:

receiving two strap end portions intermediate two weld plates such that the two strap end portions overlap at least partially;

moving the weld plates back and forth with respect to one another, so as to move the two strap end portions back and forth with respect to one another;

rocking the weld plates while the weld plates are moved back and forth; and wherein rocking the weld plates while moving the weld plates back and forth effects the formation of a weld which attaches the two strap end portions together.

2. The method as recited in claim 1, wherein the thermoplastic strap comprises a plastic selected from polypropylene and polyester.

3. The method as recited in claim 1, wherein the weld plates move back and forth longitudinally along a portion of the length of the strap with respect to one another.

4. The method as recited in claim 1, wherein the weld plates are moved in a manner which effects longitudinal movement of the two strap portions with respect to one another.

5. The method as recited in claim 1, wherein at least one weld plate has an alternating pattern of teeth formed thereon.

6. The method as recited in claim 1, wherein at least one weld plate has an alternating pattern of teeth formed thereon such that the weld plate varies longitudinally in an ability of the weld plate to grip a strap end portion.

7. The method as recited in claim 1, wherein at least one weld plate of has an alternating pattern of teeth formed thereon such that the teeth vary longitudinally in a sharpness thereof.

8. The method as recited in claim 1, wherein at least one weld plate has an alternating pattern of teeth formed thereon, wherein the teeth are defined by square based pyramids and the alternating pattern is defined by a sharpness of an apex of the pyramids.

9. The method as recited in claim 1, wherein at least one weld plate has an alternating pattern of teeth formed thereon, wherein the alternating pattern is defined by at least one portion of the weld plate having teeth and at least one portion of the weld plate not having teeth.

10. The method as recited in claim 1, wherein the weld plate has a length of approximately 3 inches and wherein the weld plate comprises:

a first toothed portion having a length of approximately 1 inch;

a first flat portion having a length of approximately ⅝ inch;

a second toothed portion having a length of approximately ⅜ inch;

a second flat portion having a length of approximately ⅝ inch; and a third toothed portion having a length of approximately ⅜ inch.

11. The method as recited in claim 10, wherein the first toothed portion, the second toothed portion, the third toothed portion, the first flat portion and the second flat portion have a width which is approximately equal to a width of the strap end portions.

12. The method as recited in claim 10, wherein the first toothed portion, the second toothed portion, the third toothed portion, the first flat portion and-the second flat portion have a width of approximately 11/16 inch.

13. The method as recited in claim 1, wherein rocking the weld plates while the weld plates are moved back and forth comprises:

rotating a shaft having a crank pin attached eccentrically thereto, the crank pin having a connecting rod rotatably attached thereto, and the connecting rod having a first one of the two weld plates rigidly attached thereto;

simultaneously urging the first and second weld plates toward one another, the second weld plate being pivotally mounted; and wherein rotating the shaft while simultaneously urging first and second weld plates toward one another results in rocking of the first and second weld plates.

14. A method for packaging material, the method comprising:

wrapping a thermoplastic strap around the material;

welding two end portions of the thermoplastic strap together, wherein welding the two end portions of the thermoplastic together comprises:

receiving two end portions of the strap intermediate two weld plates such that the two end portions overlap at least partially;

moving the weld plates back and forth with respect to one another, so as to move the two end portions back and forth with respect to one another;

rocking the weld plates while the weld plates are moved back and forth; and wherein moving the weld plates back and forth while the weld plates are rocked effects the formation of a weld which attaches the two end portions together.

15. A method for packaging fibrous material, the method comprising:

wrapping a thermoplastic strap around the fibrous material;

welding two end portions of the thermoplastic strap together, wherein welding the two end portions of the thermoplastic together comprises:

receiving two end portions of the strap intermediate two weld plates such that the two end portions overlap at least partially;

moving the weld plates back and forth with respect to one another, so as to move the two end portions back and forth with respect to one another;

rocking the weld plates while the weld plates are moved back and forth; and wherein moving the weld plates back and forth while the weld plates are rocked effects the formation of a weld which attaches the two end portions together.

16. A method for baling cotton, the method comprising:

wrapping a thermoplastic strap around a compressed quantity of cotton;

welding two end portions of the thermoplastic strap together, wherein welding the two end portions of the thermoplastic together comprises:

receiving two end portions of the strap intermediate two weld plates such that the two end portions overlap at least partially;

moving the weld plates back and forth with respect to one another, so as to move the two end portions back and forth with respect to one another;

rocking the weld plates while the weld plates are moved back and forth; and wherein moving the weld plates back and forth while the weld plates are rocked effects the formation of a weld which attaches the two end portions together.

17. A device for welding baling straps and the like, the device comprising:

two weld plates configured to receive two strap portions therebetween such that the two strap portions overlap at least partially;

a drive coupled so as to move the weld plates back and forth with respect to one another such that the two strap portions move back and forth with respect to one another;

the weld plates being configured so as to rock while the weld plates are moved back and forth; and wherein rocking the weld plates while moving the weld plates back and forth effects the formation of a weld which attaches the two strap portions together.

18. The device as recited in claim 17, wherein the two weld plates are configured so as to receive strap end portions therebetween.

19. The device as recited in claim 17, wherein the drive is coupled so as to move the weld plates back and forth longitudinally along a portion of the length of the strap with respect to one another.

20. The device as recited in claim 17, wherein the weld plates are configured to be moved in a manner which effects longitudinal movement of the two strap portions with respect to one another along a portion of the length of the strap.

21. The device as recited in claim 17, wherein at least one weld plate has an alternating pattern of teeth formed thereon.

22. The device as recited in claim 17, wherein at least one weld plate has an alternating pattern of teeth formed thereon such that the teeth vary longitudinally in an ability of the teeth to grip a strap portion.

23. The device as recited in claim 17, wherein at least one weld plate has an alternating pattern of teeth formed thereon such that the teeth vary longitudinally in a sharpness thereof.

24. The device as recited in claim 17, wherein at least one weld plate has an alternating pattern of teeth formed thereon, the teeth being defined by square based pyramids and the alternating pattern being defined by a sharpness of an apex of the pyramids.

25. The device as recited in claim 17, wherein the alternating pattern is defined by at least one portion of the weld plate having teeth and at least one portion of the weld plate not having teeth.

26. The device as recited in claim 17, wherein the weld plate has a length of approximately 3 inches and wherein the weld plate comprises:

a first toothed portion having a length of approximately 1 inch;

a first flat portion having a length of approximately 5/8 inch;

a second toothed portion having a length of approximately 3/8 inch;

a second flat portion having a length of approximately 5/8 inch; and a third toothed portion having a length of approximately 3/8 inch.

27. The device as recited in claim 26, wherein the first toothed portion, the second toothed portion, the third toothed portion, the first flat portion and the second flat portion have a width which is approximately equal to the width of the baling strap being welded.

28. The device as recited in claim 26, wherein the first toothed portion, the second toothed portion, the third toothed portion, the first flat portion and the second flat portion have a width of approximately 11/16 inch.

29. The device as recited in claim 17, wherein the drive comprises a shaft having a crank pin attached eccentrically thereto and further comprising:

a connecting rod rotatably connected to the crank pin, the connecting rod being attached to a first one of the two weld plates;

an actuator configured so as to urge the first and second weld plates together;

a pivot via which the second weld plate is mounted; and wherein rotating the shaft while simultaneously urging first weld plate and the second weld plate together results in rocking of the first and second weld plates.

30. A device for packaging material, the device comprising:

a wrapping apparatus configured to wrap a thermoplastic strap around the material;

a strap welder configured to weld two end portions of the thermoplastic strap together, wherein the strap welder comprises:

two weld plates;

a driver configured so as to move the two weld plates back and forth with respect to one another in a manner which moves the two end portions of the thermoplastic strap back and forth with respect to one another; and wherein the weld plates are configured to rock while the weld plates are moved back and forth.

31. A device for packaging fibrous material, the device comprising:

a wrapping apparatus configured to wrap a thermoplastic strap around the fibrous material;

a strap welder configured to weld two end portions of the thermoplastic strap together, wherein the strap welder comprises:

two weld plates;

a driver configured so as to move the two weld plates back and forth with respect to one another in a manner which moves the two end portions of the thermoplastic strap back and forth with respect to one another; and wherein the weld plates are configured to rock while the weld plates are moved back and forth.

32. A device for baling cotton, the device comprising:

a wrapping apparatus configured to wrap a thermoplastic strap around cotton;

a strap welder configured to weld two end portions of the thermoplastic strap together, wherein the strap welder comprises:

two weld plates;

a driver configured so as to move the two weld plates back and forth with respect to one another in a manner which moves the two end portions of the thermoplastic strap back and forth with respect to one another; and wherein the weld plates are configured to rock while the weld plates are moved back and forth.

33. A cotton baling machine comprising:

means for compressing a quantity of cotton so as to generally define a bale;

means for wrapping a plurality of straps around the bale;

means for welding opposed ends of each of the straps together, the welding means comprising:

means for holding the two opposed ends of the strap together;

means for moving the two opposed ends of the strap relative to one another such that friction results from the relative movement; and means for rocking the two opposed ends of the strap as the two opposed ends of the strap are moved relative to one another.

* * * * *

UNITED STATES PATENT AND TRADEMARK OFFICE

CERTIFICATE OF CORRECTION

PATENT NO. : 6,487,833 B1
DATED : December 3, 2002
INVENTOR(S) : Jaenson et al.

It is certified that error appears in the above-identified patent and that said Letters Patent is hereby corrected as shown below:

Column 24,
Line 39, replace “plate of has” with -- plate has --

Column 27,
Line 16, replace “urging first” with -- urging the first --

Signed and Sealed this

Thirtieth Day of December, 2003

JAMES E. ROGAN
*Director of the United States Patent and Trademark Office*